US012084963B2

(12) United States Patent
Pedersen et al.

(10) Patent No.: US 12,084,963 B2
(45) Date of Patent: Sep. 10, 2024

(54) TOOL AND METHOD FOR VERIFICATION OF PRESSURE INTEGRITY BEHIND DOWNHOLE CASING

(71) Applicant: Exedra AS, Stavanger (NO)

(72) Inventors: Bernt Reinhardt Pedersen, Stavanger (NO); Torger Skillingstad, Sandnes (NO)

(73) Assignee: Exedra AS, Stavanger (NO)

( * ) Notice: Subject to any disclaimer, the term of this patent is extended or adjusted under 35 U.S.C. 154(b) by 45 days.

(21) Appl. No.: 17/917,485

(22) PCT Filed: Apr. 16, 2021

(86) PCT No.: PCT/NO2021/050101
§ 371 (c)(1),
(2) Date: Oct. 6, 2022

(87) PCT Pub. No.: WO2021/210990
PCT Pub. Date: Oct. 21, 2021

(65) Prior Publication Data

US 2023/0160299 A1 May 25, 2023

(30) Foreign Application Priority Data

Apr. 16, 2020 (NO) ..... 20200465

(51) Int. Cl.
*E21B 47/11* (2012.01)
*E21B 47/005* (2012.01)
(Continued)

(52) U.S. Cl.
CPC ..... *E21B 47/11* (2020.05); *E21B 47/005* (2020.05); *E21B 47/098* (2020.05); *E21B 47/117* (2020.05)

(58) Field of Classification Search
CPC ..... E21B 47/11; E21B 47/005; E21B 47/098; E21B 47/117
See application file for complete search history.

(56) References Cited

U.S. PATENT DOCUMENTS 4,353,249 A * 10/1982 Lagus ..... E21B 47/11 73/152.52
2018/0179886 A1 6/2018 Espe et al.
2019/0323342 A1 10/2019 Pedersen

FOREIGN PATENT DOCUMENTS

GB 2577935 4/2020
NO 341190 9/2017
(Continued)

OTHER PUBLICATIONS

Norwegian Search Report, Norwegian Patent Application No. 20200465, date of report Nov. 13, 2020.
(Continued)

*Primary Examiner* — D. Andrews
(74) *Attorney, Agent, or Firm* — Andrus intellectual Property Law, LLP

(57) ABSTRACT

A method is for testing the pressure integrity of a barrier in an annulus outside a pipe string in a wellbore, the method including the steps of: establishing a fluid connection between an inside of the pipe string and an annulus out-side the pipe string at a first position and second positions in the wellbore, the second position being offset from the first position along the axial direction of the wellbore; establishing a temporary barrier between the fluid connections at the first and second positions in the wellbore; establishing a pressure differential across the temporary barrier; releasing a tracer from below the temporary barrier; and sniffing for tracer above the temporary barrier to verify a leakage
(Continued)

through the temporary barrier and/or the barrier in the annulus. There is also disclosed a tool for executing such a method.

16 Claims, 26 Drawing Sheets

(51) Int. Cl.
*E21B 47/098* (2012.01)
*E21B 47/117* (2012.01)

(56) References Cited

FOREIGN PATENT DOCUMENTS

| | | |
|---|---|---|
| NO | 342549 | 6/2018 |
| NO | 20180438 | 9/2019 |
| WO | 2016196253 | 12/2016 |
| WO | 2018128549 | 7/2018 |

OTHER PUBLICATIONS

International Search Report, PCT/NO2021/050101, date of mailing Sep. 15, 2021.
Written Opinion, PCT/NO2021/050101, date of mailing Sep. 15, 2021, and Reply filed Feb. 16, 2022.
Written Opinion, PCT/NO2021/050101, date of mailing Apr. 8, 2022 and Reply filed Jun. 8, 2022.
International Preliminary Report on Patentability, PCT/NO2021/050101, date of mailing Jul. 7, 2022.

* cited by examiner

TOOL AND METHOD FOR VERIFICATION OF PRESSURE INTEGRITY BEHIND DOWNHOLE CASING

CROSS-REFERENCE TO RELATED APPLICATIONS

This application is the U.S. national stage application of International Application PCT/NO2021/050101, filed Apr. 16, 2021, which international application was published on Oct. 21, 2021, as International Publication WO 2021/210990 in the English language. The International Application claims priority of Norwegian Patent Application No. 20200465, filed Apr. 16, 2020. The international application and Norwegian application are both incorporated herein by reference, in entirety.

FIELD

The present invention relates to a method for verification of the pressure integrity behind a downhole casing. In particular, the invention relates to a method where fluid communication is established between an inside of a pipe string and an annulus outside the pipe string at two different positions in the well and a barrier is established in the well between the two positions. The invention also relates to a tool for verifying the pressure integrity of a barrier behind a downhole casing.

BACKGROUND

In the oil and gas industry, safety is always a major concern. Incidents may have severe consequences, such as witnessed in the aftermath of the Deepwater Horizon catastrophe. To prevent such incidents, barriers placed in wells play a leading role. The well barriers are installed mainly to control fluid flow in the well, and ultimately to prevent a blowout, i.e. an uncontrolled release of formation fluids out of the well after the pressure control system, including one or more barriers, has failed.

A barrier set in a well may be said to have two sides: an uphole side and a downhole side. The purpose of the barrier is typically to prevent fluids from moving from the downhole side of the barrier and to the uphole side of the barrier. Therefore, the downhole side can be said to be upstream the barrier and the uphole side to be downstream the barrier.

Herein, all references to "above" and "below" a barrier should be construed as closest to surface and closest to the bottom of the well, respectively.

To ensure that a set barrier is able to withstand a given pressure, it is required to test the integrity of the barrier. Standards, such as NORSOK D-010 relating to well integrity in drilling and well operations, contain detailed requirements for testing of well barriers such as cement-based and mechanical plugs. NORSOK D-010 specifies that barriers should be tested in the direction of potential flow, i.e. an upstream test. However, in the industry cement plugs are typically tested from above as no reliable technique currently exists to effectively test them from below. A successful pressure test of a barrier from above, i.e. in the direction opposite to normal flow, does not necessarily indicate that the barrier would withstand the pressure from below. Pressure tests from above have also occasion-ally been shown to damage casing and other equipment in the well above the barrier.

From client's own WO 2018/0128549 it is known to test the integrity of barriers that are placed centrally in a well by using tracer that is released from below the barrier and where a pressure differential is created to attempt to "drive" tracer across the barrier. The document also discloses testing of so-called "perforate wash and cement" (PWC) plugs that are set in the whole cross-section of a wellbore, including in one or more annuli surrounding one or more casings in the well. A challenge with this method is that it is not possible to identify the source of any detected leakage, i.e. whether it is in the central portion of the plug or in the annulus. Another challenge is that the method may give a "false negative" if, by some malfunction, tracer was not release from the below the barrier after all. In fact, no direct, reliable method exists to test the integrity of a barrier in an annulus.

When a well is to be plugged, the status and integrity of barriers in various annuli are usually unknown. If a plug is to be set in a well at a position where one or more casings are present, the operator usually has two options: (1) Try to find out, by indirect studies (as will be explained below) the integrity of the barrier or (2) to remove all steel and cement at the relevant position in the well to set a new barrier across the full cross-section of the wellbore. The latter is usually done by so-called section milling where steel and cement is machined away over several meters or alternatively by the PWC method mentioned above, where perforations are made in the casing, but where the main portion of the casing remains in the well. Section milling is time-consuming and expensive and is therefore undesirable in itself. The alternative (1) is to try to find out if the existing cement/barrier in the annulus already has a satisfying integrity. This is typically done by studying old drilling and cement reports, assessing the qualities of the surrounding formation as well as using experience from similar wells. It is also known to run a "cement bond log", using ultrasound-based logging techniques. Such a log may give an indication if there is a satisfactory bond/binding of cement between the casing and the surrounding formation. However, it is often challenging to interpret such cement bond logs, and the logs are, in most cases, of no use if there are two or more casings. Quite often the cement will have deteriorated its bond to the casing and/or formation due to thermal expansion, underground micro earthquakes and movements, forces and vibrations in the casing during production or shrinking of the cement during curing. Because of this uncertainty, many operators choose to use the costly and timely second option, section milling or alternatively PWC. This also implies that section milling or PWC is used, even if in a situation where there already exists a satisfactory pressure integrity behind the casing and the milling or PWC process could have been avoided altogether.

SUMMARY

The invention has for its object to remedy or to reduce at least one of the drawbacks of the prior art, or at least provide a useful alternative to prior art.

The object is achieved through features, which are specified in the description below and in the claims that follow.

In a first aspect, the invention relates to a method for verifying the pressure integrity of a barrier in an annulus outside a pipe string in a wellbore, the method including the steps of:

- establishing a fluid connection between an inside of the pipe string and an annulus out-side the pipe string at a first position in the wellbore;
- establishing a fluid connection between the inside of the pipe string and the annulus outside the pipe string at a second position in the wellbore, the second position being offset from the first position along the axial direction of the wellbore;

establishing a temporary barrier in the pipe string between the fluid connections at the first and second positions in the wellbore;

establishing a pressure differential across the temporary barrier;

releasing a tracer below the temporary barrier in the wellbore; and sniffing for tracer above the temporary barrier to verify a leakage through the temporary barrier and/or the barrier in the annulus.

By "temporary" barrier herein is meant a retrievable barrier. It will also be understood that the barrier that is to be tested in the annulus is located between the fluid connections at the first and second positions, typically along the full length of the annulus between the first and second positions. The annulus barrier will typically include cement, but may also, as an alternative or addition, include other fluidized plugging materials, such as various resins or naturally occurring formation, such as shale. The inner bore of the pipe string will normally be void of any cement before the method commences, meaning that the barrier is initially only located in the annulus, and that the temporary barrier set during the method according to the invention is the only barrier in the pipe string between first and second positions.

In one embodiment, the second position in the wellbore may be deeper in the wellbore than the first position in the wellbore. Fluid communication between the inside and out-side of the pipe string may be established first at the first position or first at the second position, or fluid communication may be established simultaneously at the two position, e.g. by firing perforation guns at both positions at the same time. It should be emphasized that by "deeper" is meant a longer distance from the wellhead. In a deviated portion of the well, this does therefore not necessarily imply a larger vertical offset.

The tracer used may be any gas, liquid or substance suitable for the purpose.

In one embodiment, the tracer may be helium, another noble gas or an inert gas in general. Use of helium as a tracer may be advantageous as helium is non-toxic, inert and for most reservoirs with very low background activity downhole, implying that there will be low, if any, background "noise" from ambient helium in the well. It is possible to detect helium with high sensitivity down to the ppm level. A helium detector typically includes a helium "sniffer" connected to a mass spectrometer, or chromatograph, where the two latter are doing the actual analysis while the sniffer is collecting the gas. For regions where helium is prevalent in the reservoirs (e.g. North America) an alternative inert gas may be preferable. A person skilled in the art will be familiar with detection technology, which will not be discussed in detail herein.

In another embodiment the tracer may be a halogen or a halogen compound. The halogen or halogen compound may be a cooler such as chlorofluorocarbons (CFC), hydrochlorofluorocarbons (HCFC) and hydrofluorocarbons (HFC). Halogens or halogen compound may be detected by means of robust, well-proven, highly sensitive and low-cost detectors that are typically known from the cooling industry. The detectors may typically be ionic emission types, though detectors based on absorption of infrared light are also known to be used for this purpose.

In another embodiment the tracer may be hydrogen. The hydrogen may be mixed with nitrogen for increased stability, such as in an already commercially available and relatively low-cost mixture with 5% hydrogen and 95% nitrogen. Hydrogen is very light with high thermal velocity and low viscosity, and it has the potential of leaking through very small channels in the barrier. Hydrogen may also be detected down to the ppm level. Ambient hydrogen level in the well is expected to be very low, and there will therefore be low, if any, background noise from ambient hydrogen. A variety of different hydrogen sensors is known, each with its different advantages and disadvantages. A summary can be found in the book "Hydrogen fuel" published by CRC press in 2008 and edited by Ram. B Gupta. Chapter 15 in this book relates to "Hydrogen sensing and detection" and is written by Prabhu Soundarrajan and Frank Schweighardt. Reference is made to this chapter for an in-depth description of various hydrogen detectors. Examples of known hydrogen detectors are solid-state detectors, including metal-oxide semiconductor (MOS) and palladium-based detectors, catalytic bead (CB) detectors, electrochemical detectors, surface acoustic wave (SAW) detectors and various micromechanical (MEMS) detectors. Solid state hydrogen detectors may be preferred in some embodiments due their low prize, compactness, low maintenance requirements and flexible geometry.

In yet another one embodiment the tracer may be an isotope, a radioactive material or any detectable chemical or radioactive gas, such as gas molecules containing tritium.

In other embodiments the tracer may be a liquid tracer such as nitrate or organic molecules dissolved in water, such as methanol, ethanol or isopropanol. Hydro-carbons can also be used dissolved in water. These tracers may also use radioisotopes for detection, such as Tritium. In case one or several of these compounds are naturally present in the well, it is possible to combine several of them as a tracer to create a 'finger-print' where the relative quantities between them are known. This will create a unique detection signature in a chromatograph or mass spectrometer, distinguishing it from any background signature. This may also be advantageous since it allows the use of infrastructure which is normally already present at the well site to perform the detection/sniffing. In yet another embodiment, fluoridising particles mixed with water may be used as tracer, also allowing the use of relatively cheap and easily accessible detection/sniffing equipment.

The step of releasing tracer below the temporary barrier in the well may be done by releasing tracer from a canister or similar provided below the temporary barrier. In an alternative embodiment, tracer may be released from a position above the temporary barrier and lead to the space below the temporary barrier through a conduit providing fluid communication between the released tracer and the volume below the temporary barrier. A canister may be provided in the well above the temporary barrier, or a conduit may be extending from topside and downhole (such as through a coiled tubing or dill pipe), whereby tracer may be released from topside and into the space below the temporary barrier in the well. Displacement of tracer from a position above the temporary barrier to a volume below the temporary barrier may e.g. be enabled by releasing tracer from a pressurized canister or my means of a pump or similar.

By providing a temporary barrier in the well, it may be possible to test the integrity of the barrier in the annulus. If the sniffing for tracer at a location in the well above the temporary barrier, after release of the tracer below the temporary barrier is negative, i.e. with no detection of tracer, it may be concluded that both the barrier in the annulus and the temporary barrier in the pipe string are intact.

Creating a pressure differential across the temporary barrier may be done by increasing the pressure below the barrier and/or by reducing the pressure above the barrier in the well. The increased pressure may be obtained by releasing tracer from a high-pressure container below the barrier. A reduced pressure above the temporary barrier may be obtained by control of a topside pump circulating fluids into and out of the well, or by swabbing. Swabbing may be performed by detaching the tool with isolation member, as will be discussed below, from the string (pipe, tubing or wire) by which it is deployed into the well and pulling the string outwardly/up in the wellbore. The detached part of the string may be provided with an additional swab cup for enhancing the swabbing effect. The effect, with or without additional swab cup, will be similar to a piston being pulled out of a syringe, i.e. a pressure drop across the piston. This will create a reduced pressure in the wellbore above the isolation member.

In one embodiment, the step of sniffing for tracer may include the steps of circulating well fluid by means of a fluid-carrying string from a position above the temporary barrier to topside and sniffing for tracer topside. This may be advantageous for easy access for maintenance of sensors. It may also be advantageous due to a wide number of commercially available detection solutions. It may also be advantageous for reducing the amount of tracer to be release since there is no need to saturate a large volume of mud or other wellbore fluid with tracer in the wellbore. The embodiment may further include the steps of:

- positioning a circulation opening of the fluid-carrying string at a position A proximate the fluid connection through the pipe string at the first position in the wellbore;
- circulating wellbore fluid from position A in the wellbore to topside;
- positioning a circulation opening of the fluid-carrying string at a position B closer to the temporary barrier in the well; and
- circulating wellbore fluid from position B in the wellbore to topside.

The applicant has realised that if a leak occurs across the temporary barrier in the pipe string, and if the is no or little circulation of well fluids (mud) from the volume immediately above the temporary barrier, some or all of the tracer tends not to percolate or diffuse upwardly in the wellbore, but instead is saturated into the wellbore fluid due to the high pressure, and remains in the volume just above the temporary barrier. Therefore, by sniffing at two different locations, A and B, where location A is near the fluid connection at the first position in the wellbore and where location B is closer to, and preferably immediately above the temporary barrier in the well, it may be possible to distinguish between leaks of tracer that have occurred through the annuls barrier and through the temporary barrier in the pipe string. This implies that it may also be possible to exclude false positives, i.e. that when tracer is detected near location B but not near location A, this may still be indicative of an intact annulus barrier. It should also be noted that one and the same circulation opening in the fluid-carrying string may be used to circulate from both position A and B by moving the fluid-carrying string. Alternatively, the fluid-carrying string may be provided with two or more circulation openings that are selectively controllable to open/close, so that circulation from positions A and B may be performed without moving the fluid-carrying string. Position B, near the temporary barrier in the pipe string, may be in certain embodiments be in the order of 5 meters, preferably 3 meters and even more preferably 1 meter above temporary barrier.

In an alternative embodiment, the step of sniffing for tracer may include the step of sniffing for tracer in the wellbore above the temporary barrier. In this embodiment, a sensor/sniffer is deployed downhole where sniffing is performed in the well. Sensor data may be communicated topside in real-time or stored in memory downhole and collected upon retrieval of the memory topside. An advantage of downhole sniffing is that the wellbore fluid does not have to be circulated topside. The method may therefore be fully performed using a non-circulating deployment string, such as wireline or slickline.

In another alternative embodiment, the method may include the step of sampling/collecting wellbore fluid at locations A and B and analysing the samples when retrieved topside. This method may also be fully performed by means of wireline or slickline.

In one embodiment, the method according to the alternative embodiment may include the steps of:

- sniffing for tracer at a position A proximate the fluid connection through the pipe string at the first position in the wellbore; and
- sniffing for tracer at a position B closer to the temporary barrier in the well.

One and the same sniffer may be moved between position A and position B, or sniffing may be done by different sniffers simultaneously or at different points in time. Also when sniffing or sampling at two different positions A and B, it may also be possible to exclude false positives, i.e. that when tracer is detected near location B but not near location A, this may still be indicative of an intact annulus barrier.

In one embodiment, the method may further include the step of removing the temporary barrier in the well. By circulating, sniffing or sampling from position B, i.e. near the position where the temporary barrier was set, it may then be possible to exclude any false negatives, i.e. that tracer was indeed released in the well and that lack of detection was not due to a malfunctioning release.

In a second aspect the invention relates to a tool for testing the pressure integrity of a barrier in an annulus outside a pipe string in a wellbore, the tool being conveyable on a wellbore conveying member and the tool comprising:

- means for establishing a fluid connection between an inside of the pipe string and an annulus outside the pipe string;
- an isolation member for creating a temporary barrier in the well; and
- a tracer release member adapted to release tracer below the isolation member on the tool.

The tracer release member may in certain embodiments be a pressurized container or canister provided on the tool below the isolation member. However, the tracer release member may also be provided above the isolation member, where a fluid conduit/channel/pipe connects the tracer release member with tool below the isolation member so that tracer may be released below the isolation member. The fluid channel may be provided with a check valve or similar to prevent back-flow of tracer. As an alternative to a pressurized container, the tracer release member may be a non-pressurized container. Where the pressure gradient over the isolation member is to be provided by means of an overpressure from below the isolation member, this may also be obtained by means of a pump/pressuriser in fluid communication with the tracer release member.

The means for establishing fluid communication may e.g. be, but is not limited to, a perforation gun, a drill bit, abrasive fluids or a set of shearing knives.

In one embodiment, the tool may comprise two isolation members provided with an axial distance between them, where the tracer release member is adapted to release tracer between the two isolation members. As explained above, the tracer release member may be located between the two isolation members, but in alternative embodiments it may be located above the upper isolation member or below the lower isolation member, where tool is provided with fluid conduit so that the tracer release member may release tracer into the volume between the isolation members.

The isolation member may in certain embodiments be a plug, such as a bridge plug, or various re-settable packers. In other embodiments, where two or more isolation members are provided, the isolation members may be retrievable/re-settable packers or swab cups. Swab cups may be connected to a so-called cup-to-cup tool providing fluid communication with a drill pipe or coiled tubing on which it is deployed. By pumping of fluid through the deployment string, the cup-to-cup tool enables establishing an overpressure between the swab cups for setting the swab cups in a sealing engagement with the inside of the pipes string to establish a temporary barrier. The cup-to-cup tool also enables release of the overpressure through the deployment string to equalise the pressure.

In one embodiment, the tracer release member may be adapted to release tracer to create an overpressure between the isolation members in the well. In addition, or as an alternative, the isolation members may also be used to create a reduced pressure in the well above the isolation member(s) by swabbing, as explained above. Alternatively, or as a further addition, the flow rate of a topside wellbore fluid circulation pump may also be adjusted to reduce the pressure in the well above the upper isolation member to create a pressure gradient across the upper isolation member to assist in driving tracer across the barrier.

In one embodiment the tool may be formed with a selectively openable circulation opening for circulating wellbore fluid to topside. The tool may also be provided with selectively openable circulation openings at two different positions, both above the upper isolation member on the tool. This may be advantageous for not having to detach the pipe string from the tool to perform circulation. In an alternative embodiment, the tool may be provided with one or more sniffers for sniffing for tracer downhole as explained above. In yet another embodiment, the tool may be provided with one or more samplers as explained above.

In a third aspect the invention relates to a wellbore tool assembly comprising a tool according to the second aspect of the invention and further comprising a wellbore conveying means connected to the tool and adapted to convey the tool into and out of the wellbore.

There is also described herein a dual pipe system that may be used in a method according to the invention. The dual pipe system may be provided in the form of two concentrically arranged drill pipes or by providing a small diameter continuous conduit/pipe inside a coil tubing string or inside another larger outer diameter pipe/tubing. The outer pipe/tubing is the load carrying element that carries the string used to deploy the tool according to the invention into the wellbore. The inner pipe/conduit is connected, in a fluid communicating manner, to a port provided below the isolation member, in case of one isolation member, or between the isolation members, in case of two isolation members, as disclosed above.

Once the isolation member is set in a sealing engagement with the inside of the pipe string in the wellbore, tracer may be released from topside at a desired volume and overpressure, through the inner pipe/conduit and out through the port, whereby tracer is release below the isolation member in the well. A circulation port is provided in the outer pipe/tubing of the dual pipe system which his then opened at or near the fluid connection in the pipe string at the first position in the wellbore. In this way, fluid communication is established between the annulus outside the pipe string (which integrity is to be tested) and the annulus in between the pipe(s)/conduit in the dual pipe system. Circulation of fluid from topside may then be started. If there is a leak in the annulus cement/barrier, tracer will enter the annulus in the dual pie system, follow the circulation fluids to topside where it will be detected/sniffed by a topside tracer detection system.

BRIEF DESCRIPTION OF THE DRAWINGS

In the following are described examples of preferred embodiments illustrated in the ac-companying drawings, wherein.

DETAILED DESCRIPTION OF THE DRAWINGS

Figure 1:
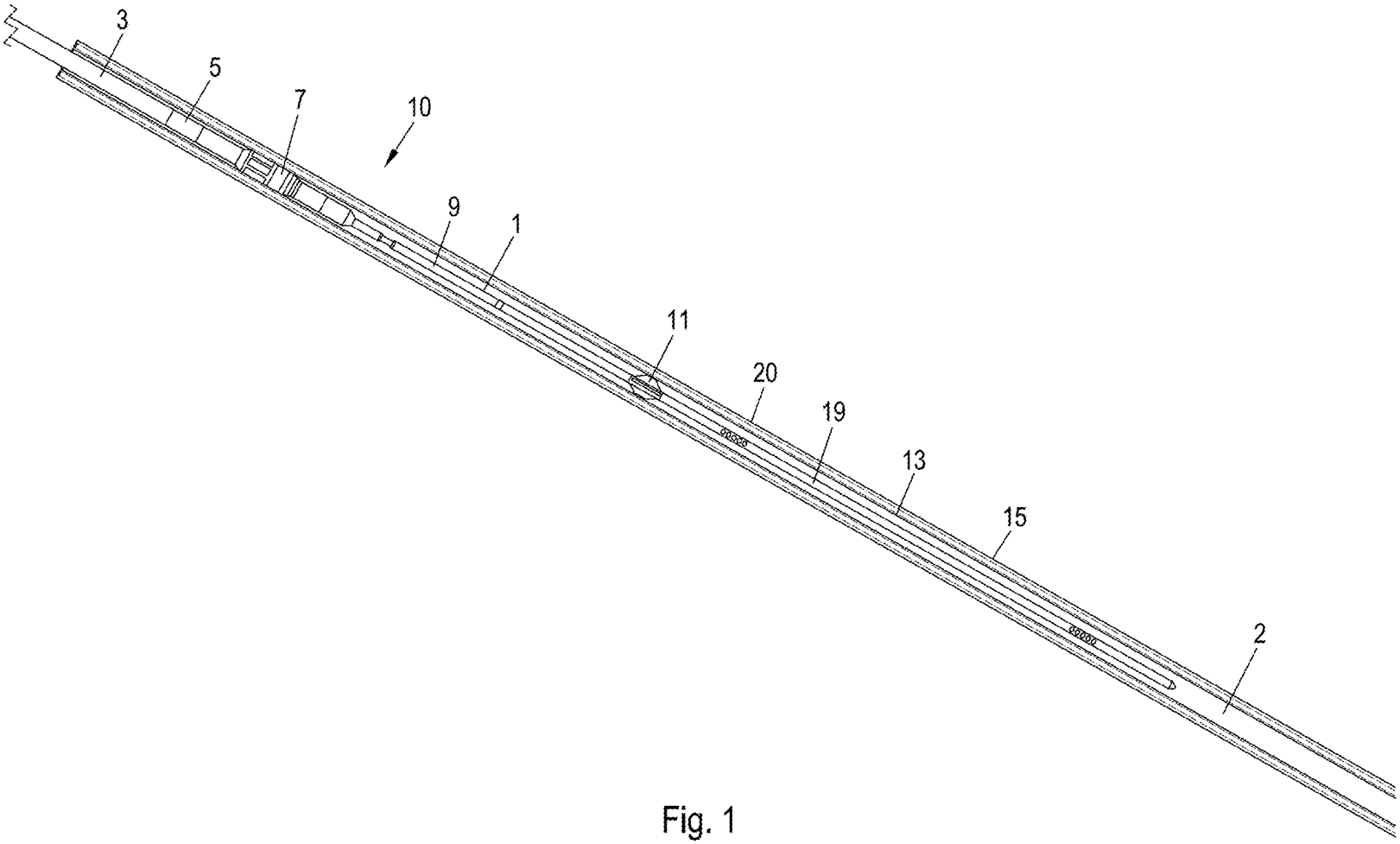
FIGS. 1-7 show steps in a first method carried out by means of a first tool according to the invention.

In the following, reference numeral 1 will be used to denote a tool according to the present invention, while reference numeral 10 denotes a wellbore tool assembly according to the invention. The drawings are shown simplified and schematically and the various features therein are not necessarily drawn to scale. Identical reference numerals refer to identical or similar features in the drawings.

FIG. 1 shows a downhole tool 1 run into a wellbore 2 and connected to wellbore conveying means 3, here shown in the form of drill pipe 3. A connector 5 releasably connects the tool 1 to the drill pipe 3. The tool 1 connected to the drill pipe defines the wellbore tool assembly 10. The tool 1 is provided with an isolation member 7, here shown in the form of a bridge plug. Below the bridge plug 7 the tool 1 is provided a tracer release member 9 in the form of a pressurized canister. The canister 9 may be of the type disclosed in client's own WO2018/128549 A1, to which reference is made for a detailed disclosure of how tracer may be released in the well and by which mechanisms the release may be triggered. Below the canister 9, the tool 1 is provided with a centraliser 11 for maintaining the tool 1 in a central position in the wellbore 2. At its distal end, the tool 1 is provided with a device for establishing fluid communication between a pipe string 13, here in the form of a casing, and annulus 15 between the casing 13 and a not shown surrounding formation. In the shown embodiment the device for establishing fluid communication between the inside of the casing 13 and the annulus 15 on the outside is a perforation gun 19. The perforation gun 19, which is releasably connected to the lower end of the centraliser 11, is adapted to fire at two different positions along the tool 1 as will be explained with reference to the following drawings.

Figure 6:
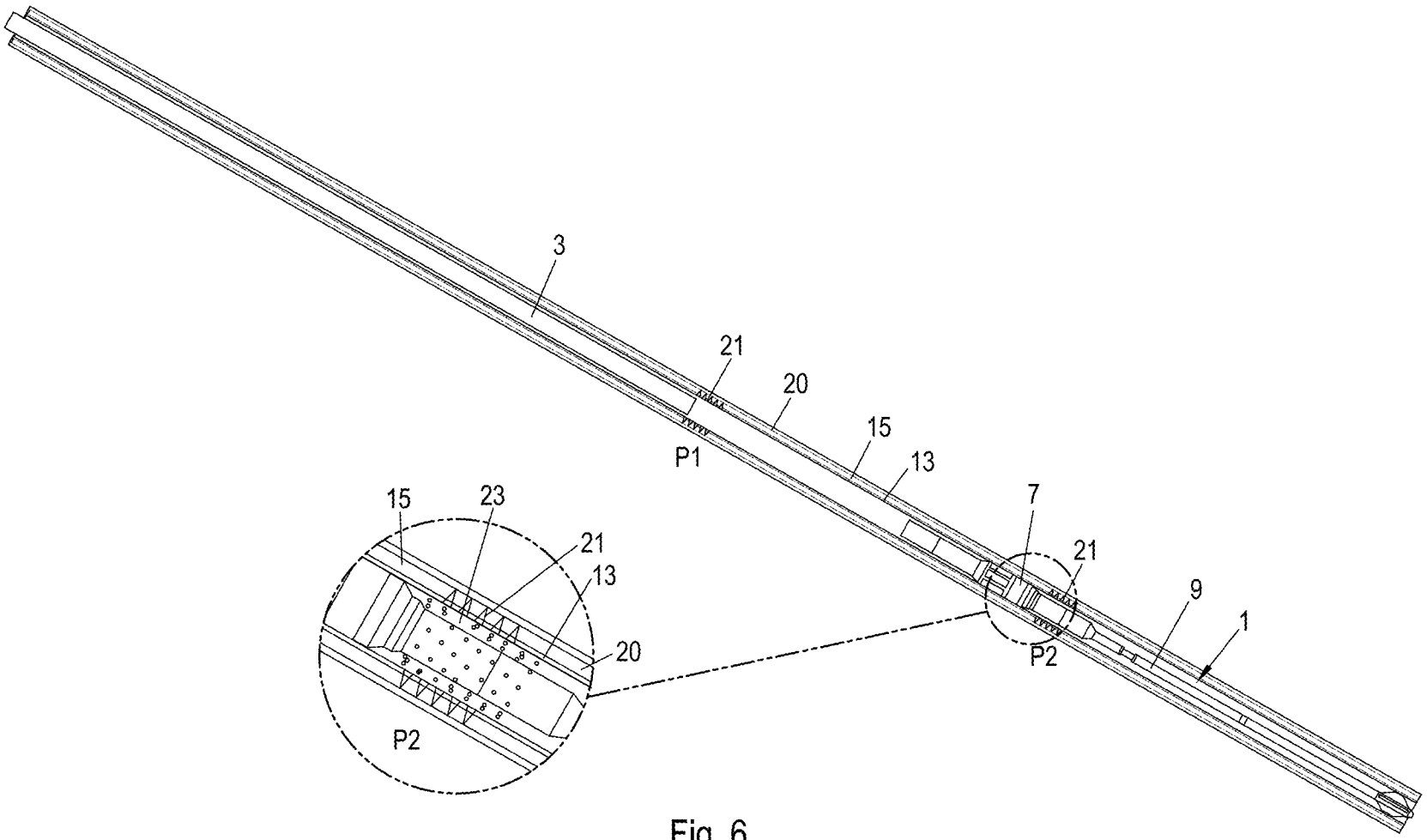

In FIG. 1 the tool 1 is positioned so that the perforation gun 19 is located adjacent a portion of the annulus 15 with cement 20, as best in the enlarged views, e.g. in FIG. 6. The aim of the method according to the invention is to verify the integrity of the cement/barrier in the annulus as explained above and as will be exemplified in the following.

Figure 2:
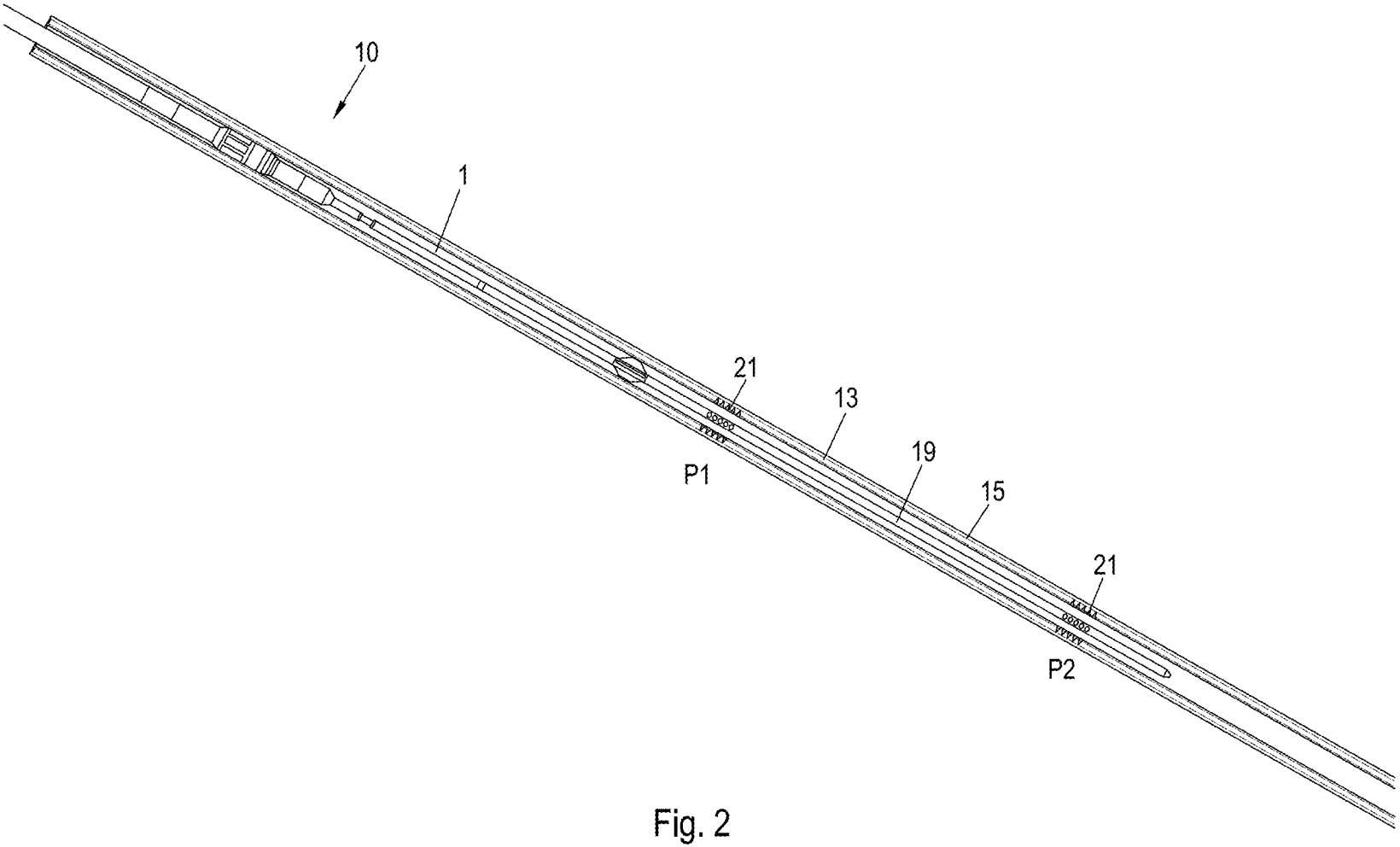

In FIG. 2 the tool 1 is shown after the perforation gun 19 has fired to create perforations 21 that establish fluid connection between the inside of the casing 13 and the annulus 15 at a first position P1 and a second position P2 in the wellbore 2. The distance between the two positions P1 and P2 may typically be in the order of 50 meters. However, this may vary depending on the type of well and relevant, applicable standards and regulations.

Figure 3:
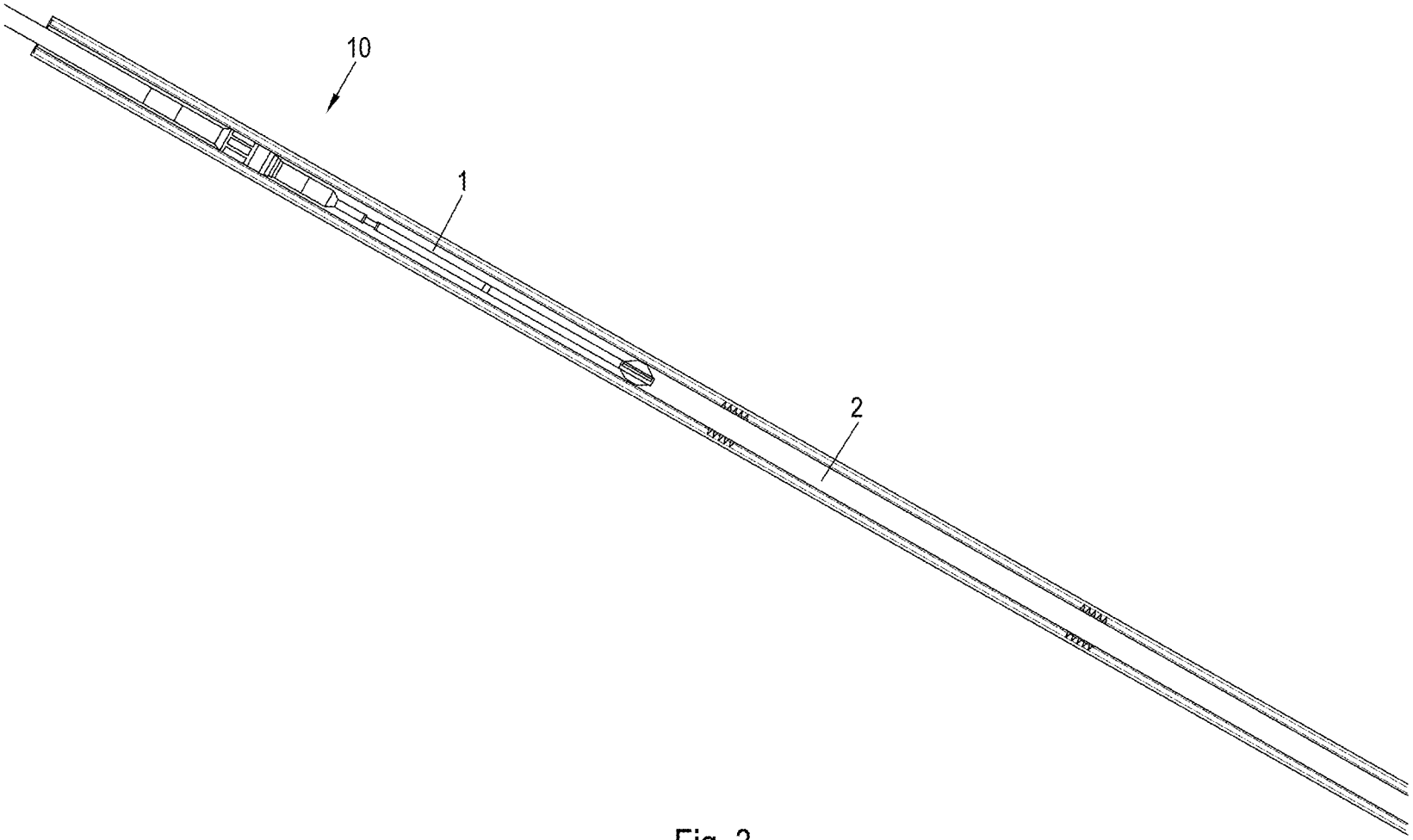

FIG. 3 shows the tool after the perforation gun 19 has been released from the rest the tool 1 and dropped into the wellbore 2.

Figure 4:
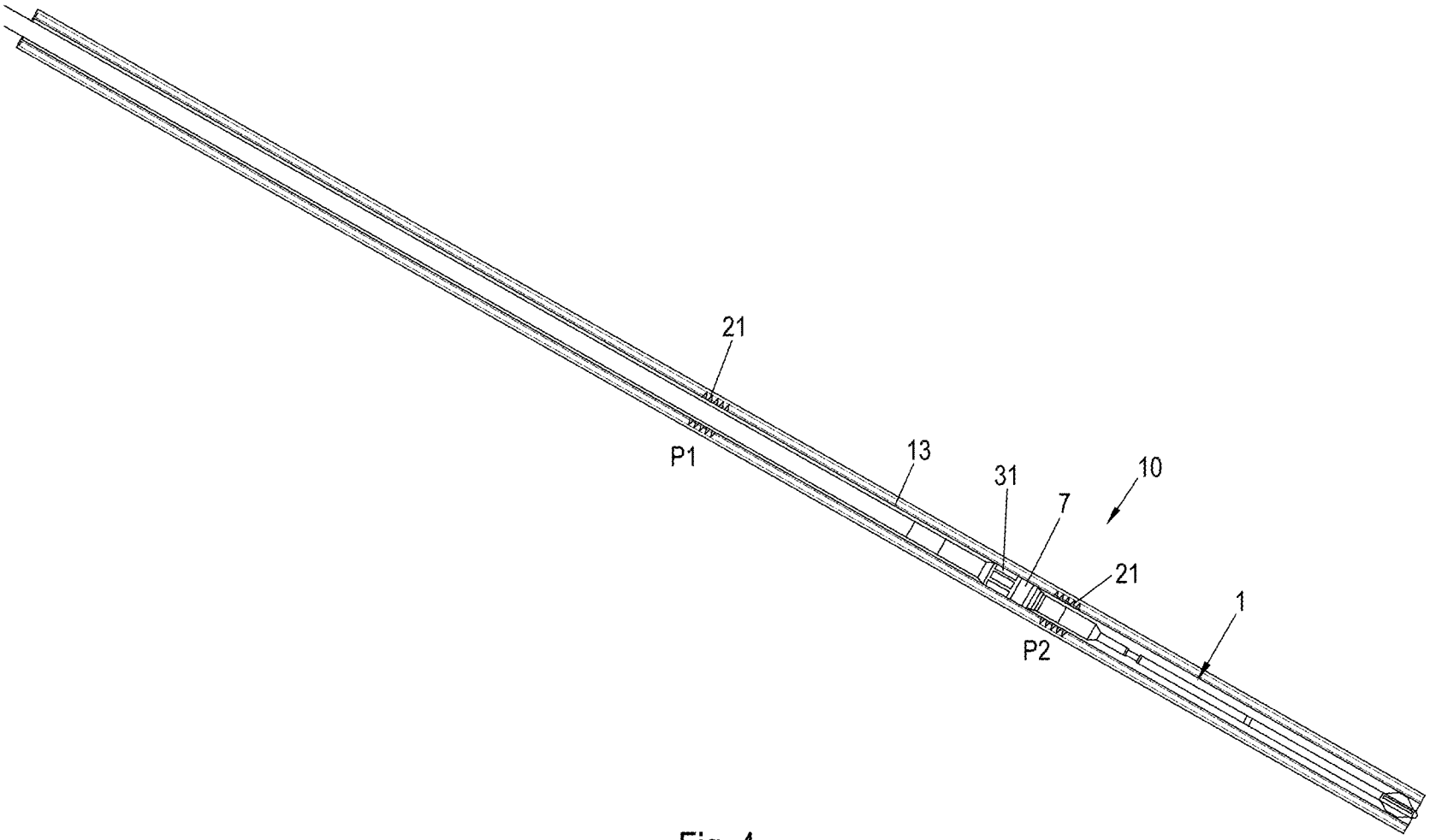

In FIG. 4 the tool 1 has been moved further into the well so that the bridge plug is 7 placed between perforation 21 at positions P1 and P2, just above the perforations 21 at the lower position P2. The bridge plug 7 is then expanded to an isolating/sealing engagement with the inside of the casing 13 to create a temporary barrier inside the casing 13 between the two sets of perforations 21. Drag blocks 31 provide torsional resistance needed to set the bridge plug 7 by rotation of the drill pipe 3.

Figure 5:
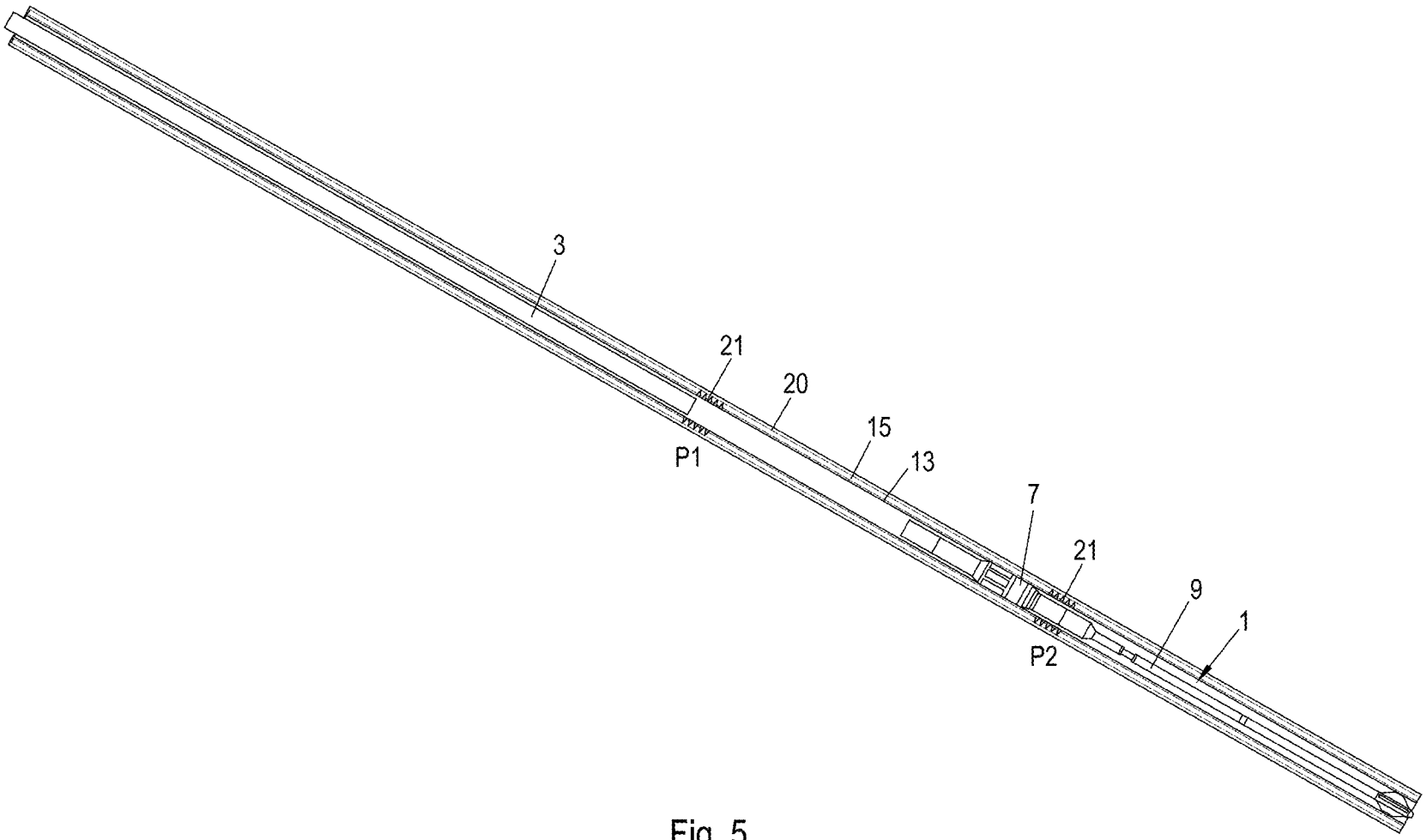
Figure 7:
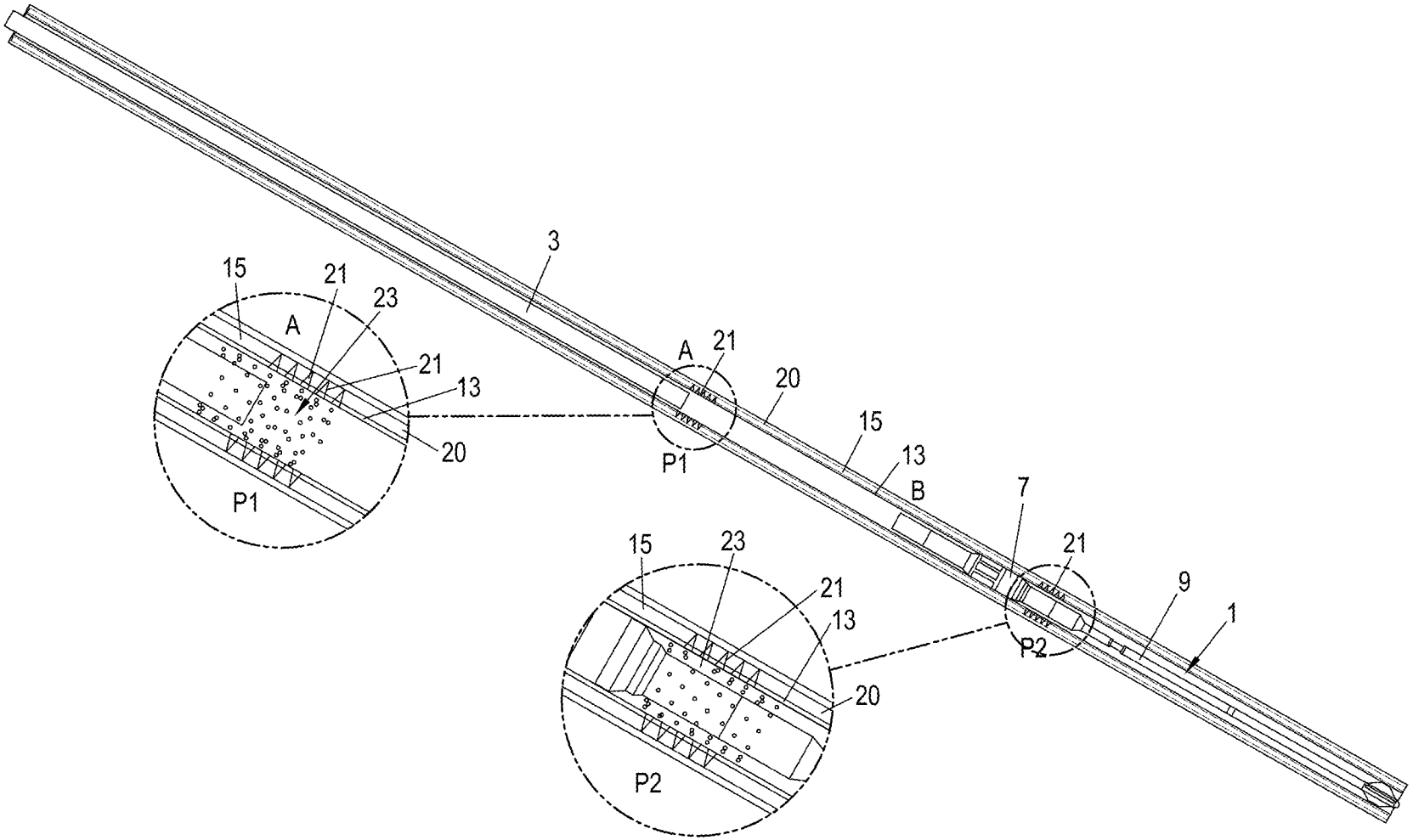

The drill pipe 3 is then separated from the tool 1 as shown in FIG. 5. The bridge plug 7 may provide sufficient axial friction to anchor the tool 1 in the wellbore 2 when separated from the drill pipe 3. Alternatively, the tool 1 may be provided with a not shown anchor in the form of slips or similar. Tracer 23 is now released from the canister 9 as shown in FIG. 6 and best seen in the enlarged section to the lower left. If the bridge plug 7 is properly set and sealing against the inside of the casing 13, the only possible route to leak for the tracer 23 is from the canister 9 inside the casing 13, out though lower perforations 21 at position P2 and into the annulus 15 with the cement 20. The pressure difference aims to drive the tracer 23 through the barrier/cement plug 20 in the annulus 15 and back into the casing 13 through the upper perforations 21 at position P1. Circulation of fluid from topside through the open end of the drill pipe 3 may now start. In the shown embodiment, the open end of the drill pipe 3 is placed at position A adjacent the upper perforations 21 at position P1. Detection of tracer 23 by means of a topside, not shown sensor/sniffer when circulating from this position, will be indicative of leak through the cement 20 in the annulus 15 as indicated in FIG. 7. To exclude a false negative result, the method may also include the step of retracting/retrieving the bridge plug 7 from its sealing engagement with the inside of the casing 13, whereby tracer "trapped" below the bridge plug will now be released into the wellbore so that it can be circulated topside and detected/sniffed. If still no tracer 23 is detected after retracting the bridge plug 7, then this is indicative that no tracer was released after all, and that the test cannot be trusted. Though not shown for this embodiment, it is also possible to circulate from different positions in the wellbore 2, including from the position shown in FIGS. 5-7 adjacent the upper perforations 21, as well as at a lower position (B) closer to the bridge plug 7 as explained above and exemplified below.

Figure 8:
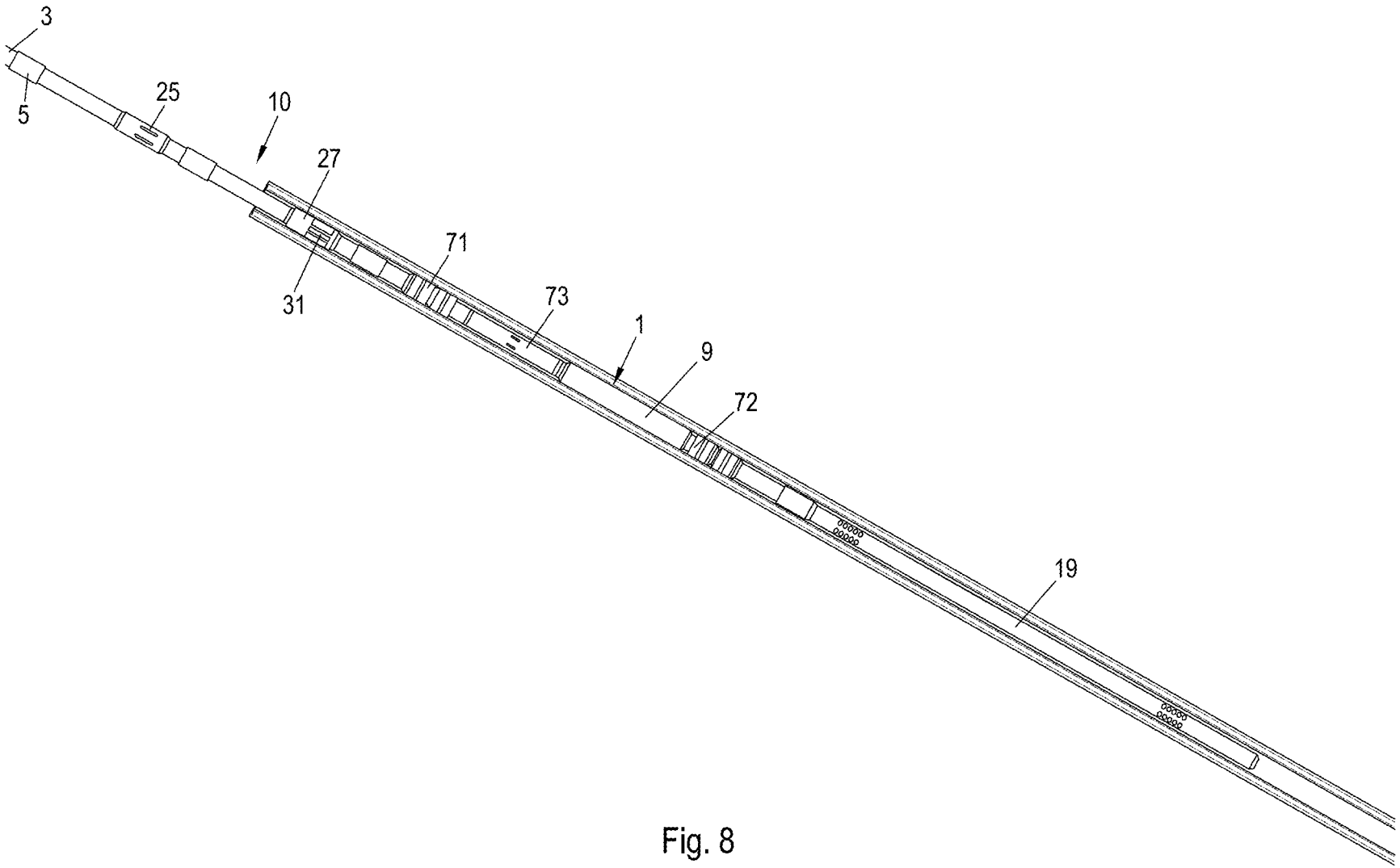
FIG. 8-14 show steps in a second method carried out by means of a second tool according to the invention.

In FIG. 8, another embodiment of a tool 1 according to the invention is shown. Instead of the bridge plug shown in FIGS. 1-7, the tool 1 is now provided with two isolation members in the form of upper and lower sets of swab cups 71, 72. The canister 9 (here shown in blue colour) is integrated into the tool between the swab cups 71, 72. A cup-to-cup tool 73 is also provided between the swab cups 71, 72, above the canister 9. The cup-to-cup tool 73 provides fluid communication with the drill pipe 3, whereby the necessary overpressure to set the swab cups 71, 72 may be pumped from topside, through the pipe string 3 and out into the volume between the swab cups 71, 72 through one or more ports/openings in the cup-to-cup tool 73. This embodiment of the tool 1 is also provided with a perforation gun 19 at its distal end, the perforation gun 19 being releasably connected to the rest of the tool 1 so that it can be dropped after firing. At its proximal end, between the connector 5, connecting the tool 1 to the drill string 3, and the upper set of swab cups 71, the tool 1 provided with two selectively openable circulation openings 25, 27. The upper selectively openable circulation opening 25 is shown in the form of a circulation sub and the lower selectively openable circulation opening 27 in the form of a ball valve which is opened/closed by left hand/right hand rotation, respectively, of the drill pipe 3. The drag blocks 31 in certain embodiments also provide the torsional resistance needed to open/close the ball valve 27.

Figure 9:
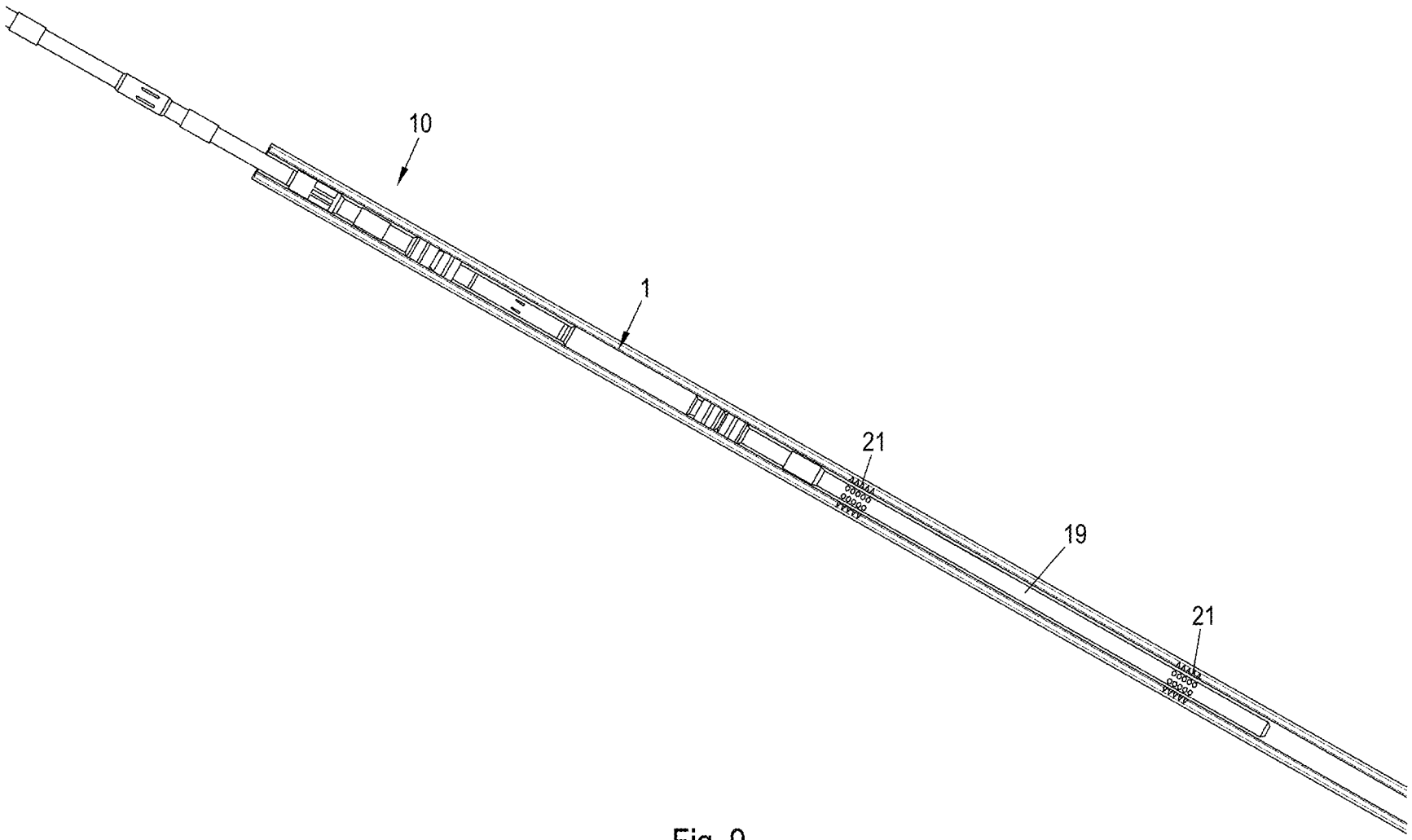
Figure 10:
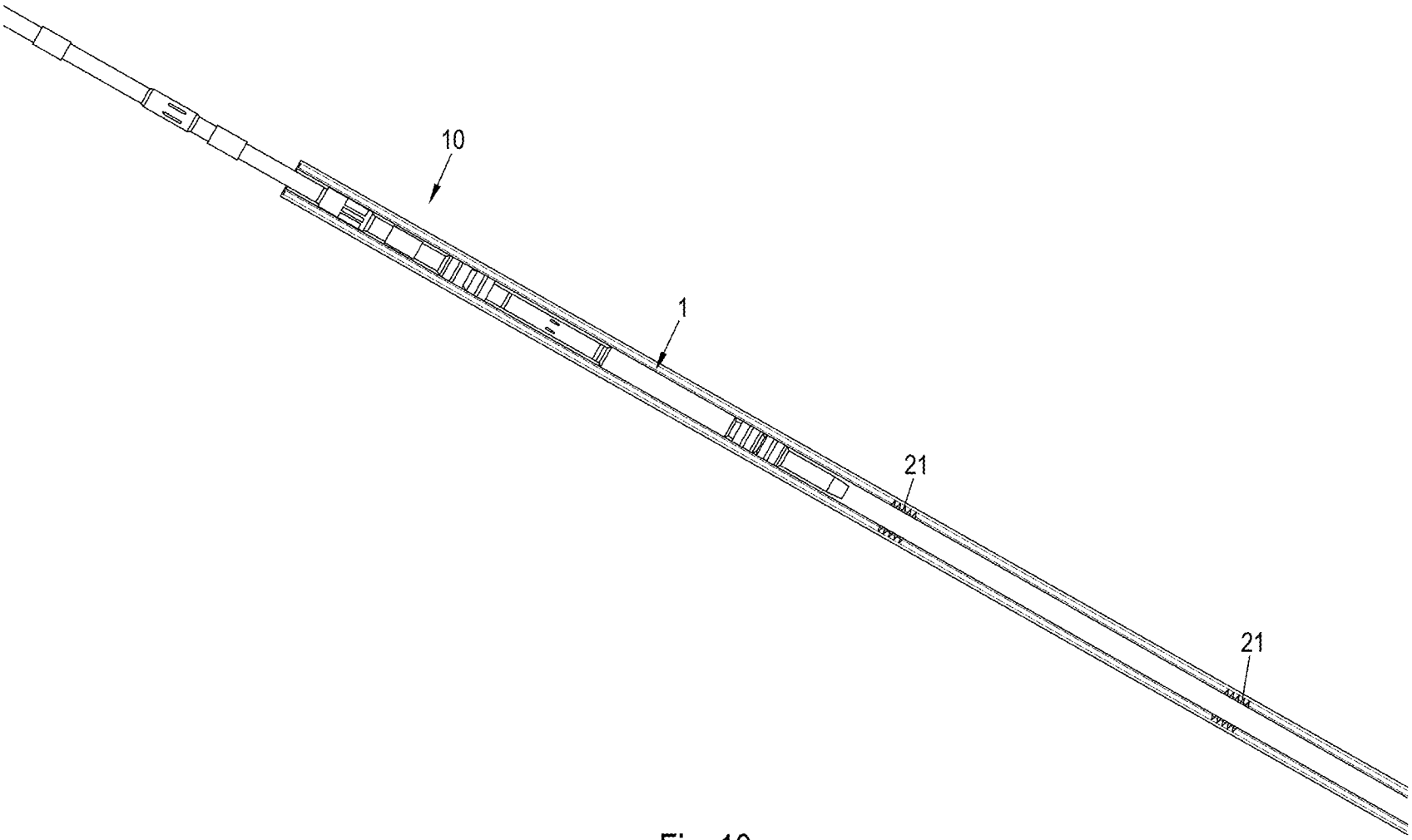
Figure 11:
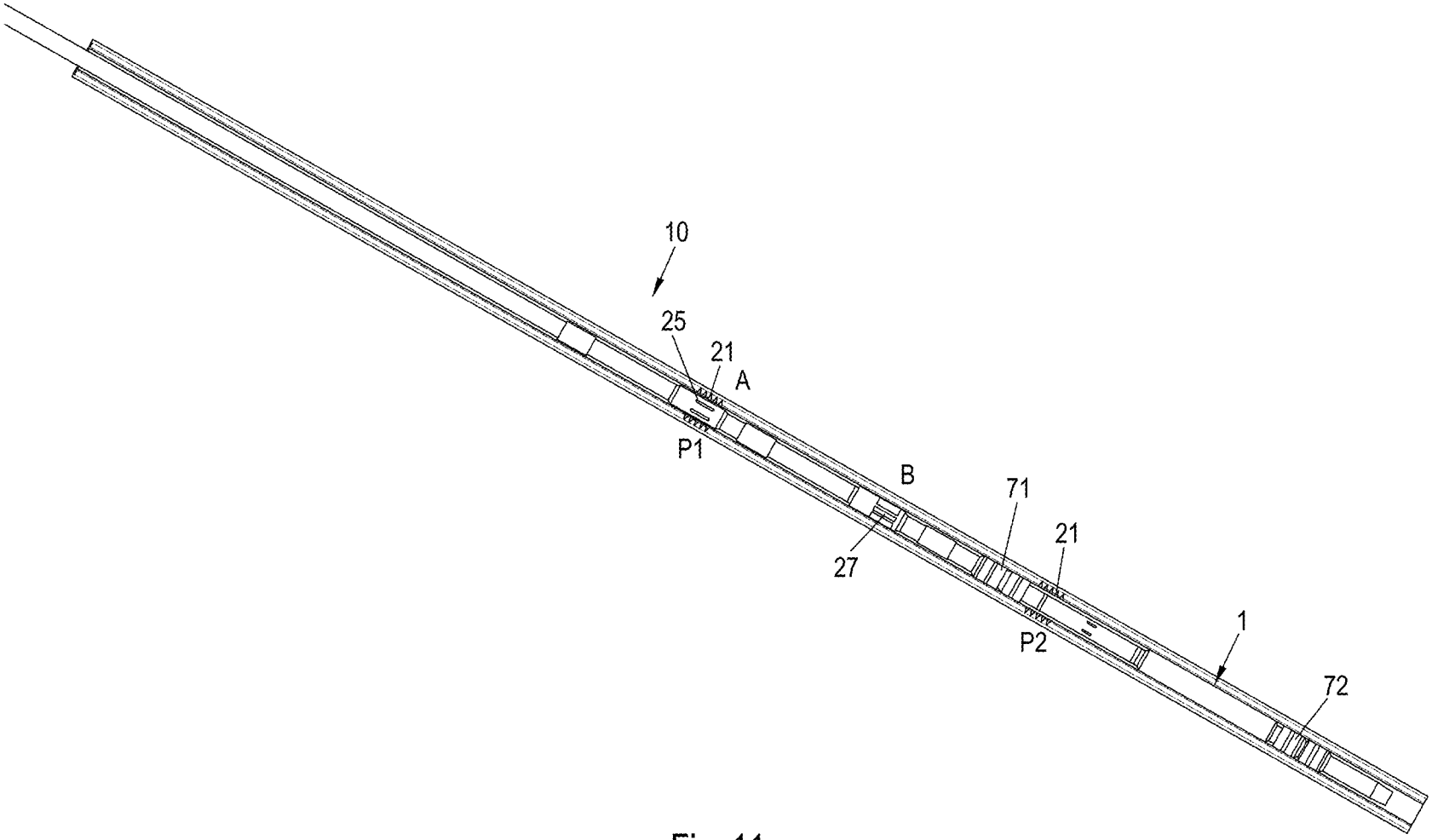
Figure 12:
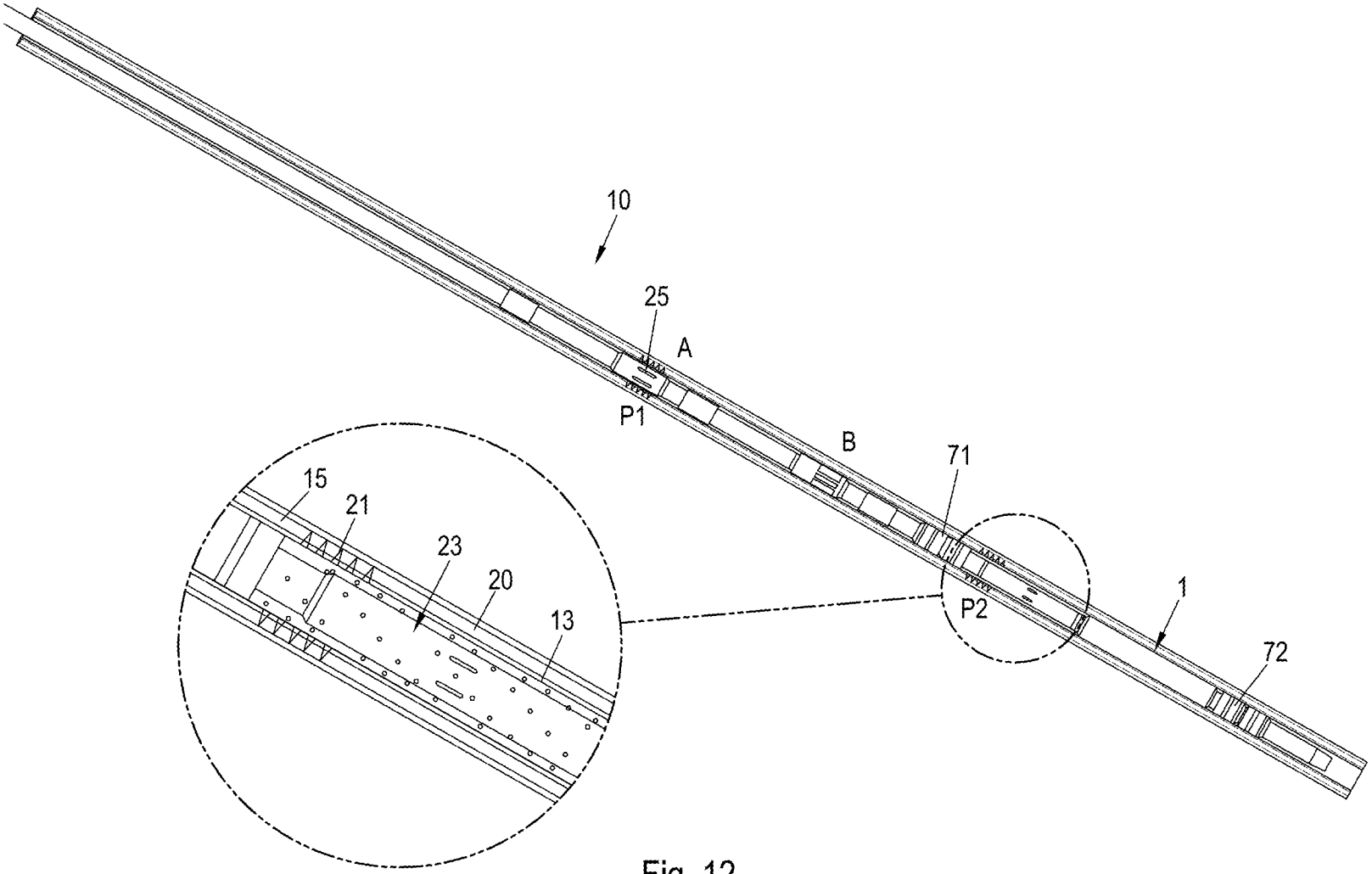
Figure 13:
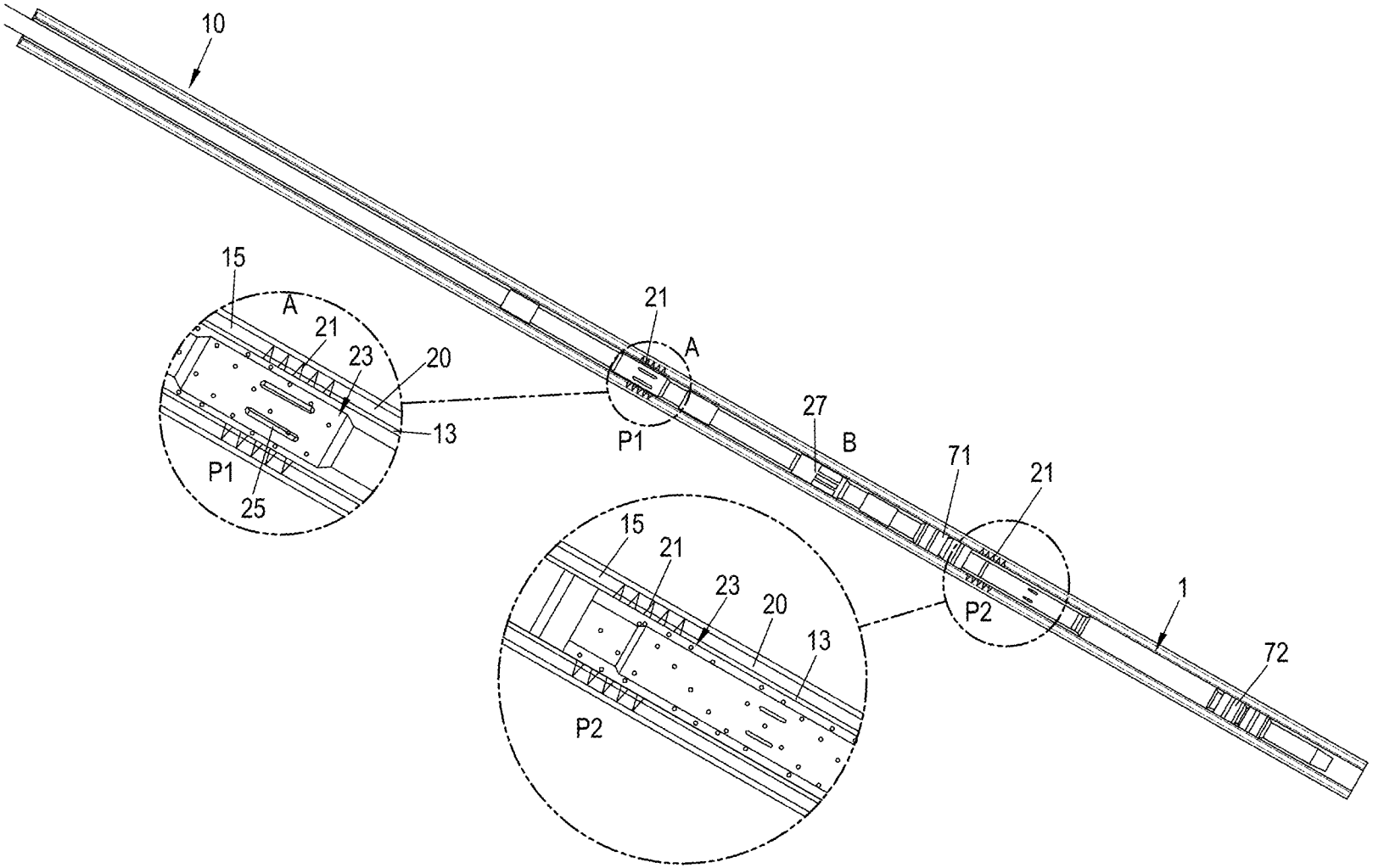
Figure 14:
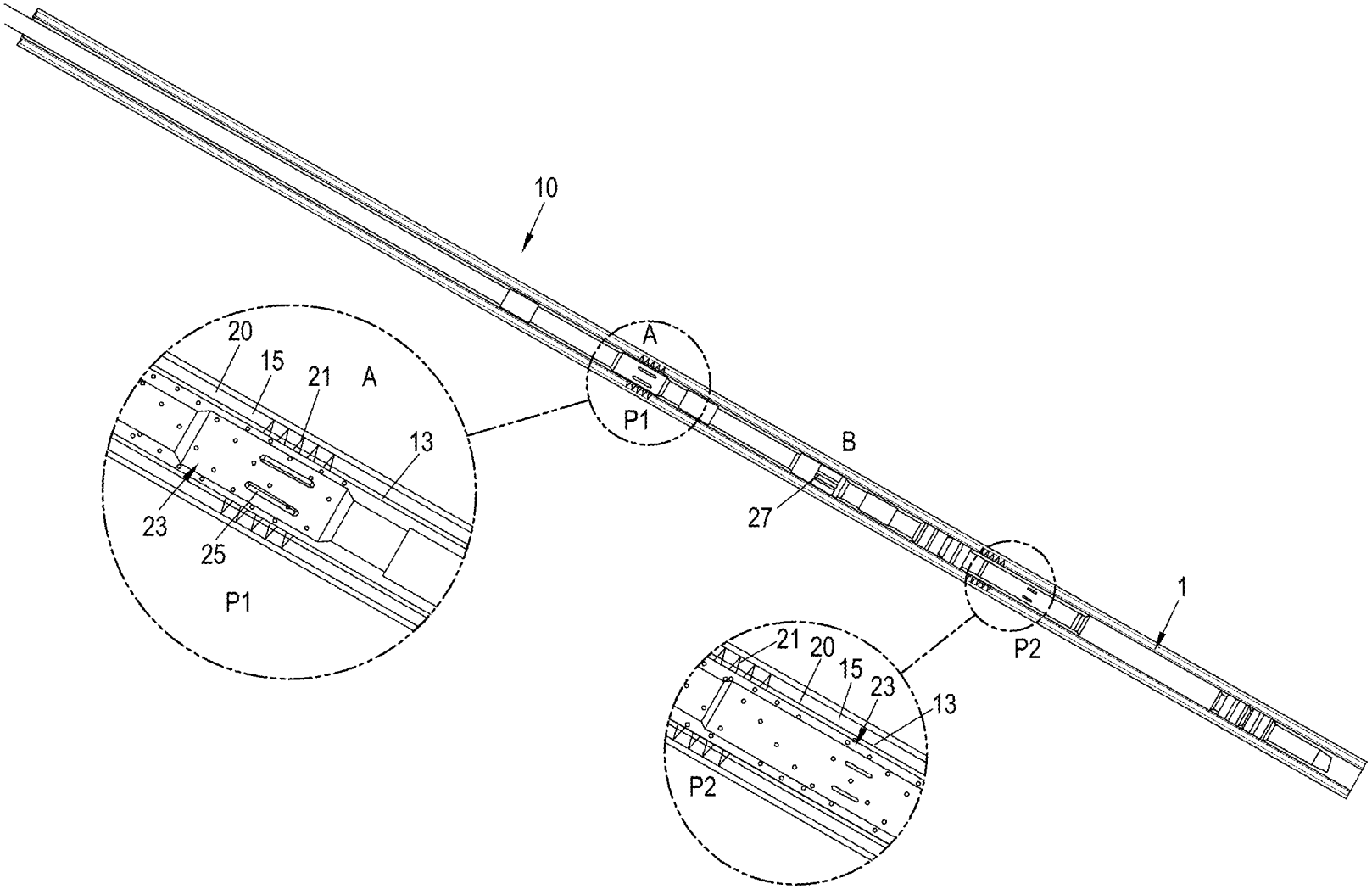

FIGS. 9 and 10 show the firing and release of the perforation gun 19. As shown in FIG. 11, the tool 1 is run further into the wellbore 2 so that the upper set of swab cups 71 is positioned just above the lower set of perforation 21 at position P2, while the circulation sub 25 is placed at a position A adjacent the upper perforations 21 at position P1. The ball valve 27 is placed below the circulation sub closer to the upper set of swab cups 71 at a position B in the wellbore 2. FIG. 12 shows the tool 1 as tracer 23 is being released from the canister 9 between the sets of the swab cups 71, 72 as best seen in the enlarged view to the lower left in the figure. If the barrier 20 in the annulus is leaking, tracer will leak out through the upper perforations 21 at position P1, as indicated in FIG. 13. Circulation of wellbore fluid from topside may now start, as indicated in FIG. 14, and any leaked tracer may be detected by a not shown sniffer topside. Since both the both the ball valve 27 and circulation sub 25 are selectively openable, it is possible to selectively circulate from either of the positions B and A, respectively, whereby it becomes possible to distinguish between a leak originating from the upper set of swab cups 71 and the cement 20 in the annulus between the perforations 21 at positions P1 and P2. After circulation has been performed from both positions A and B, the pressure gradient across the upper set of swab cups 71 may be equalised and the sealing engagement between the swab cups 71, 72 and the inside of the casing ceases. False negatives may thus be detected as explained above.

Figure 15:
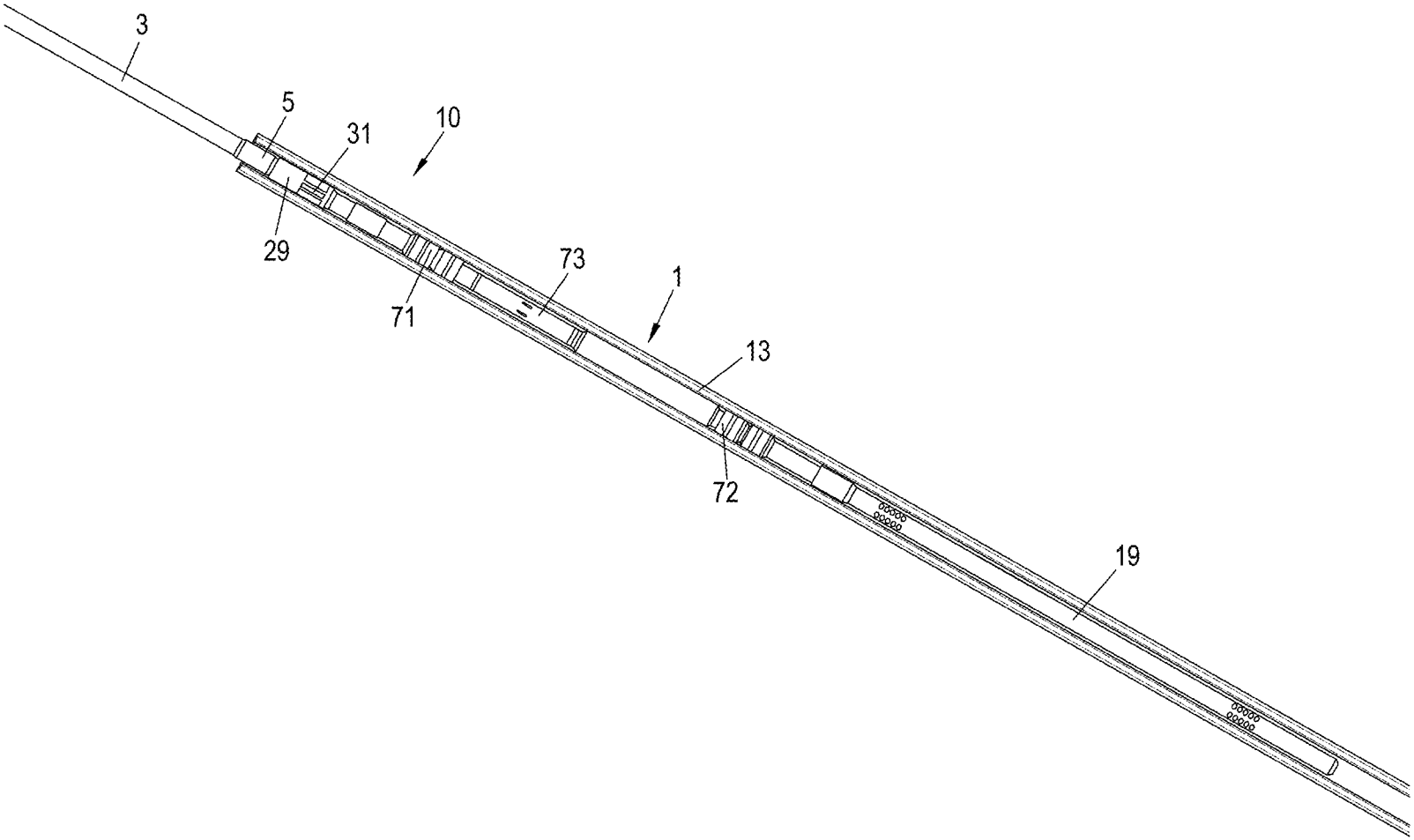
FIGS. 15-26 show steps in a third embodiment carried out by means of a third tool according to the invention.

FIG. 15 shows a third embodiment of a tool 1 according to the present invention. The tool 1 is releasably connected to the drill pipe 3 at connector 5. Below the connector 5, the tool 1 is provided with a flapper valve 29 and set of drag blocks 31 as disclosed above, where the drag blocks 31 may be used to anchor the tool 1 torsionally in the wellbore 2 to detach the drill pipe 3 from the tool 1 by rotation. In some aspects the tool 1 according to this third embodiment is quite similar to the tool 1 of the second embodiment shown in FIGS. 8-15, but instead of being provided with selectively openable fluid circulation openings, the drill pipe 3 is adapted to detach from tool 1 so as to circulate from the open, distal end of the drill pipe 3, similar to the first embodiment shown with reference to FIGS. 1-7.

Figure 16:
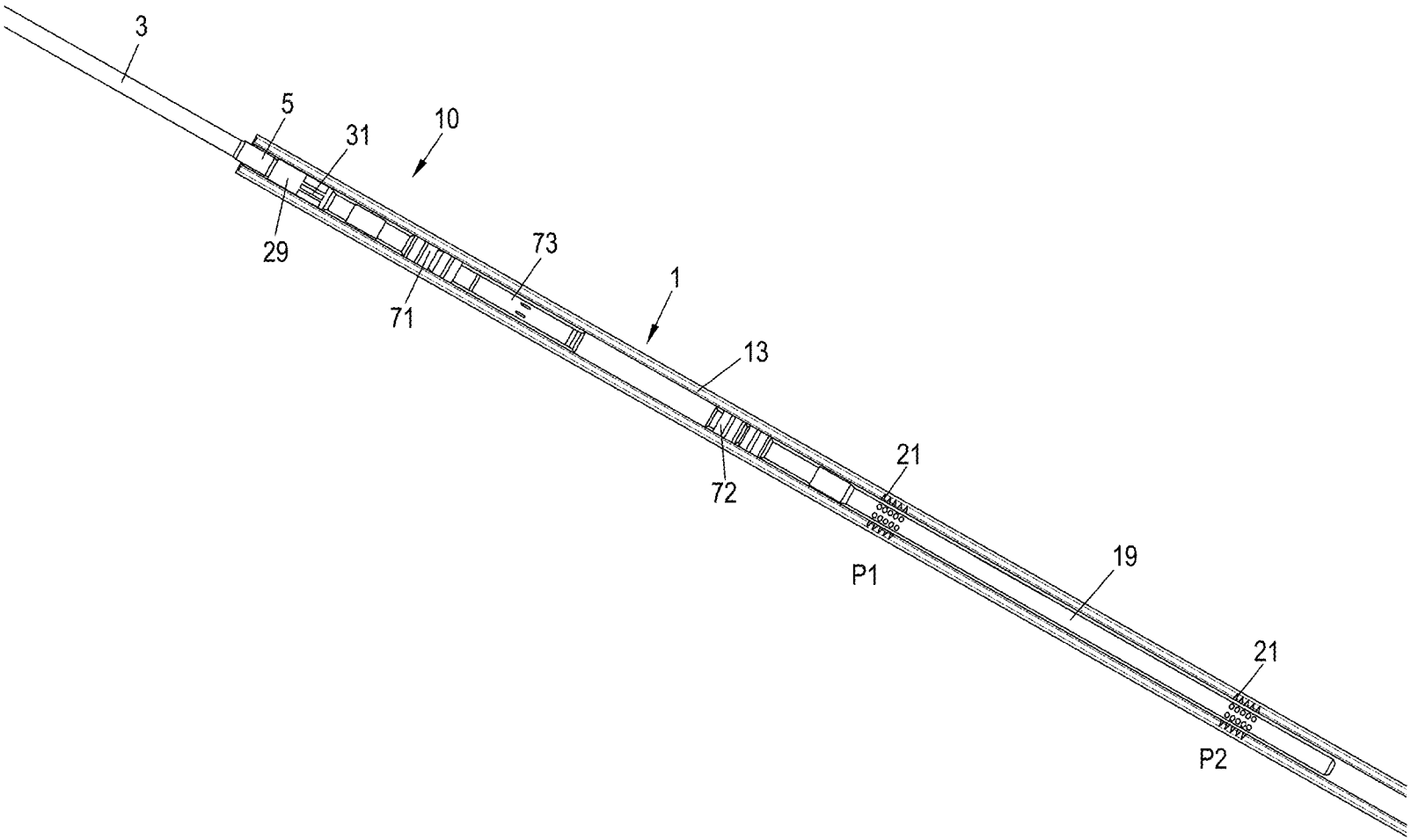
Figure 17:
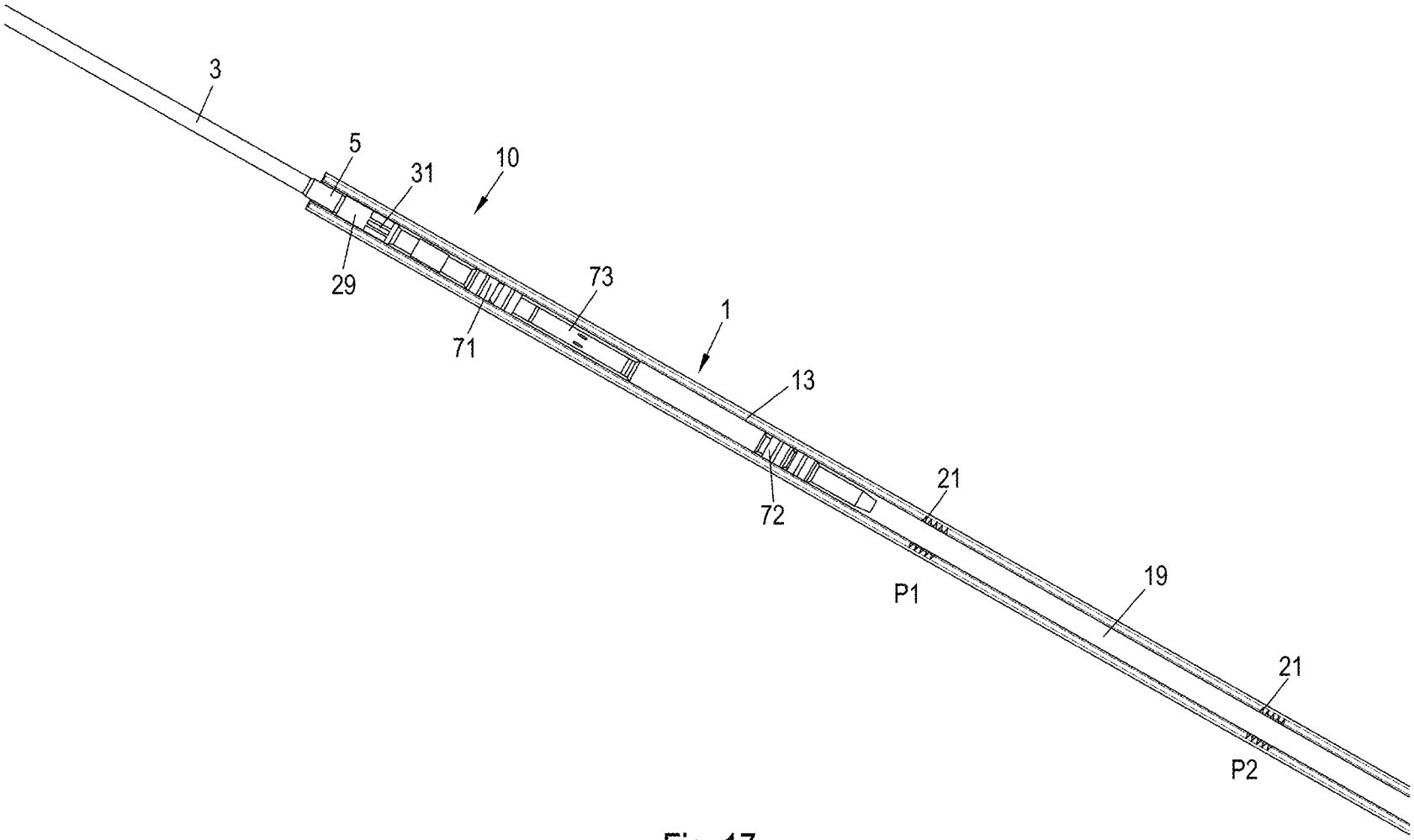
Figure 18:
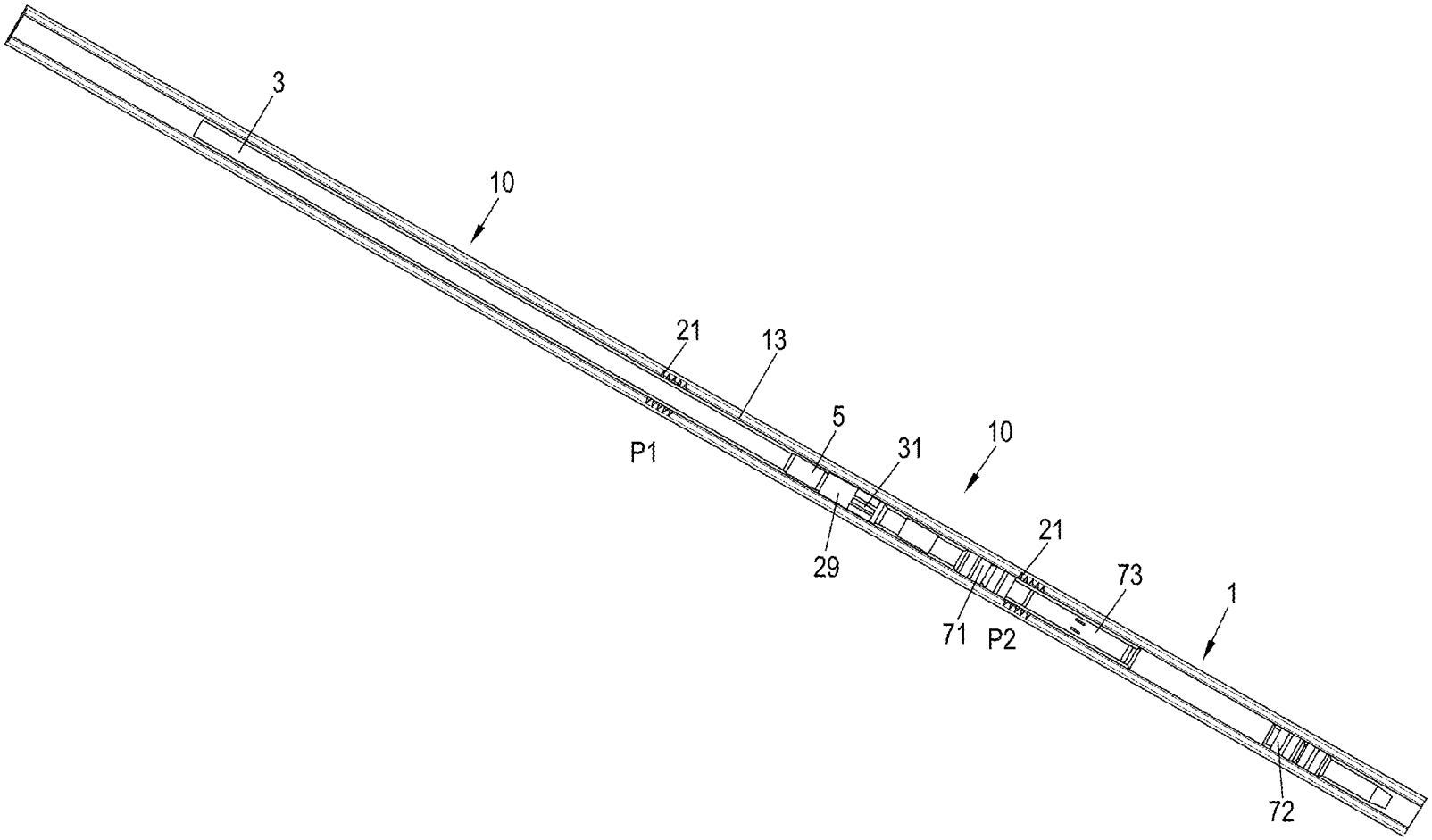
Figure 19:
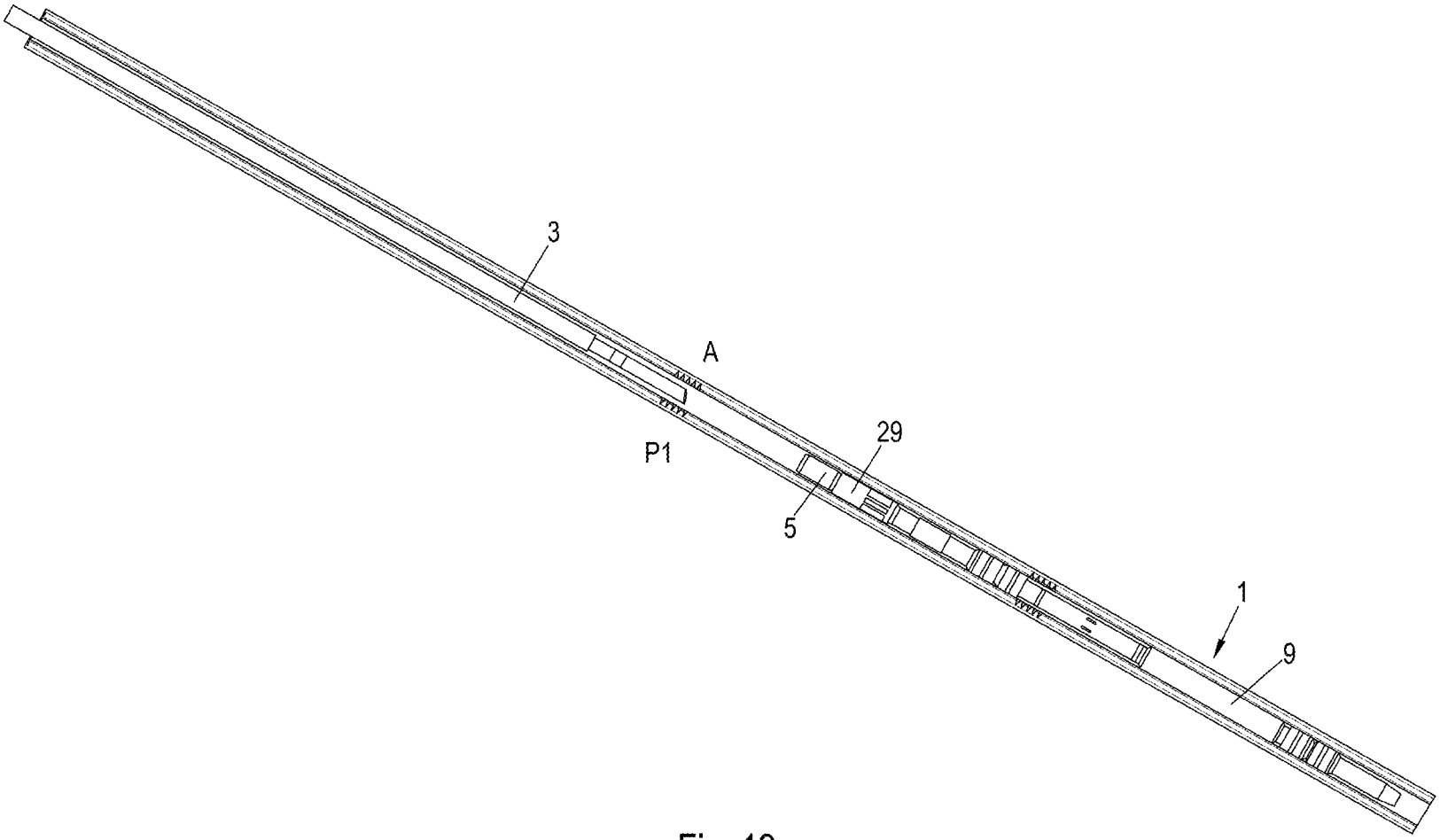
Figure 20:
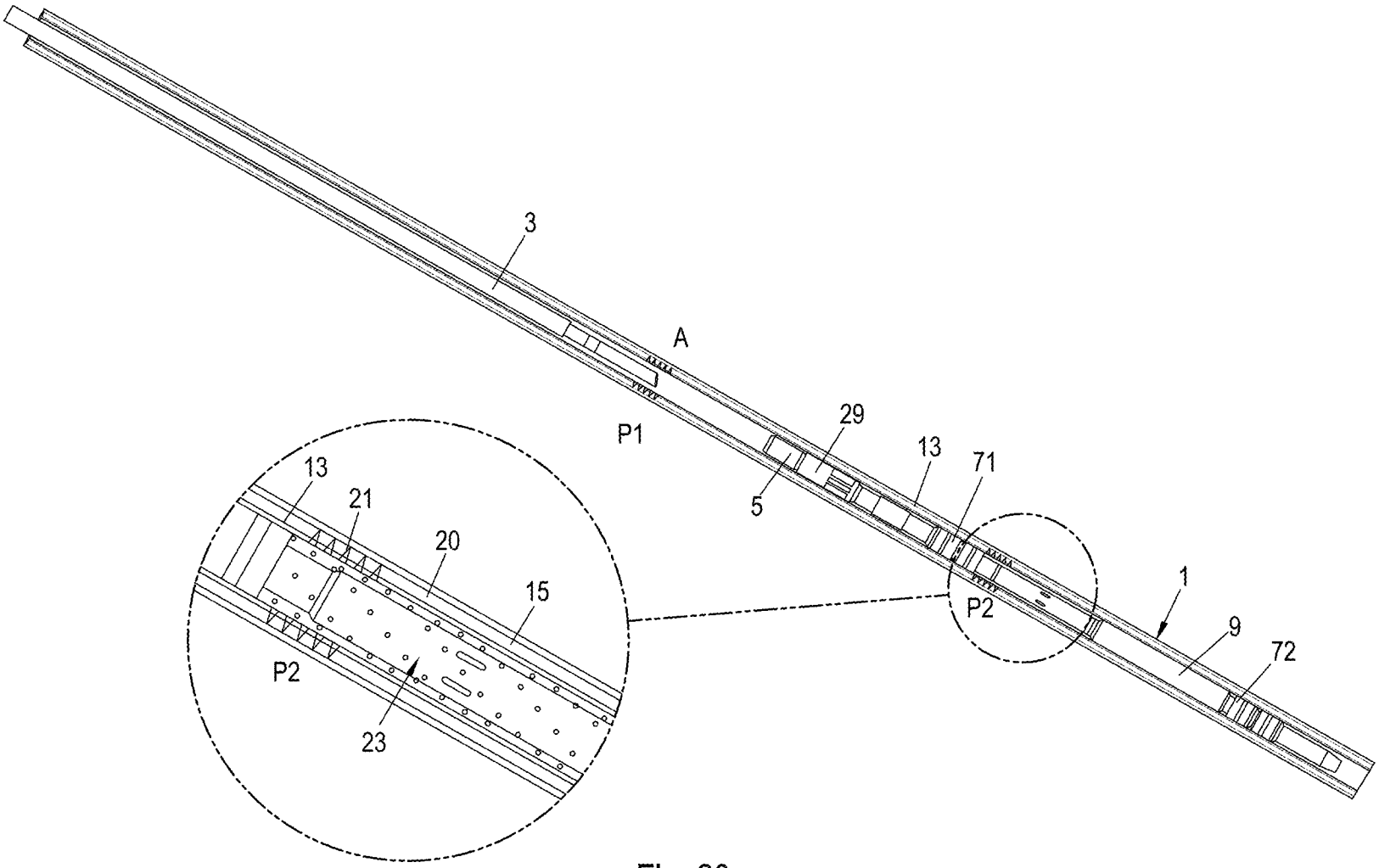
Figure 21:
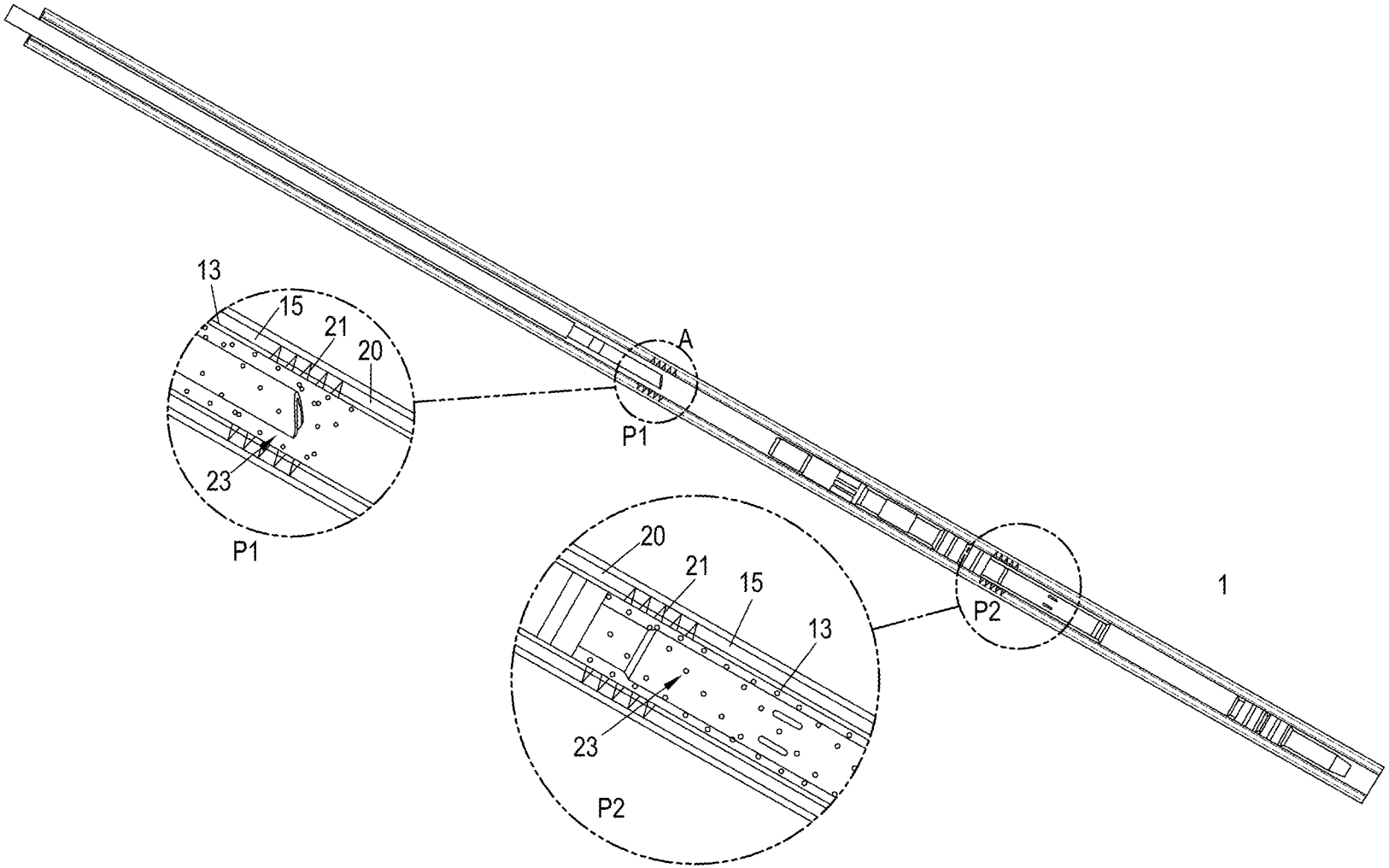

In FIGS. 15-17, the tool 1 is positioned adjacent the cemented annulus portion that is to be tested, the perforation gun 19 is fired, the gun 19 is released from the rest of the tool 1 and dropped into the well. In FIG. 18 the tool 1 is positioned with the upper set of swab cups 71 just above the lower set of perforations 21 at position P2. The sets of swab cups 71, 72 are exposed to a pressure gradient by pressurizing the volume between the swab cups 71, 72 through the cup-to-cup tool 73, as disclosed above, whereby they expand to a sealing engagement with the inside of the casing 13. The sets of swab cups 71, 72, when properly set may provide sufficient axial friction to anchor the tool 1 in the wellbore. Alternatively, the tool 1 may be provided with a not shown anchor in the form of slips or similar. The drill pipe 3 then detaches from the tool 1, thereby also closing the flapper valve 29. As shown in FIG. 19, the open, distal end of the drill pipe 3 is then positioned at position A near the upper perforations at position P1. Tracer 23 is released from the canister 9 between the sets of swab cups 71, 72, as indicated in FIG. 20. If the sets of swab cups 71, 72 are properly set and sealing against the inside of the casing 13, the integrity of the annulus cement barrier 20 may be tested and verified by means of the tools and methods according to the invention disclosed herein. In FIG. 21, the enlarged detail to the left indicates tracer 23 that has leaked through the cement barrier 20 and back into the casing 13 at position P1.

Figure 22:
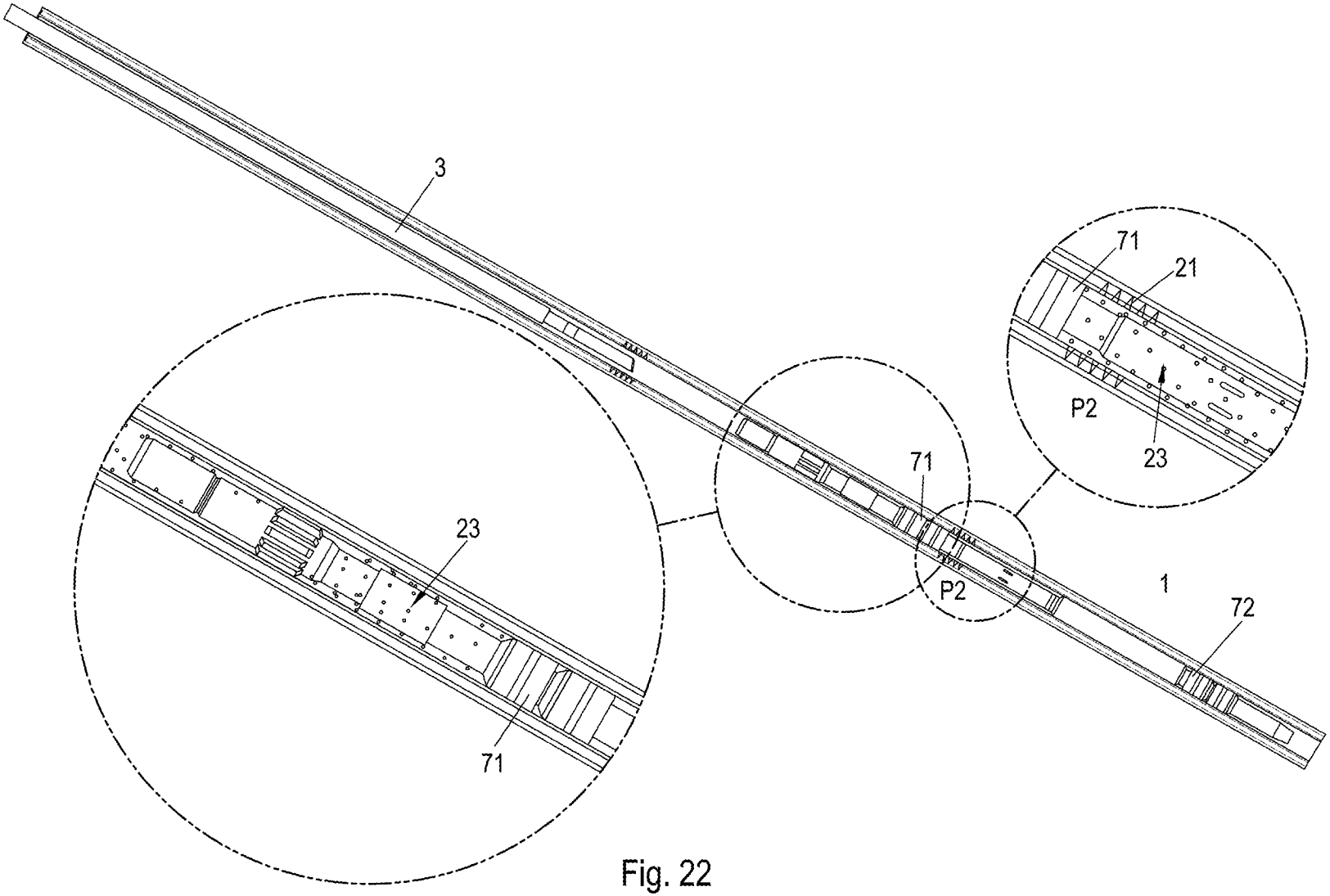
Figure 23:
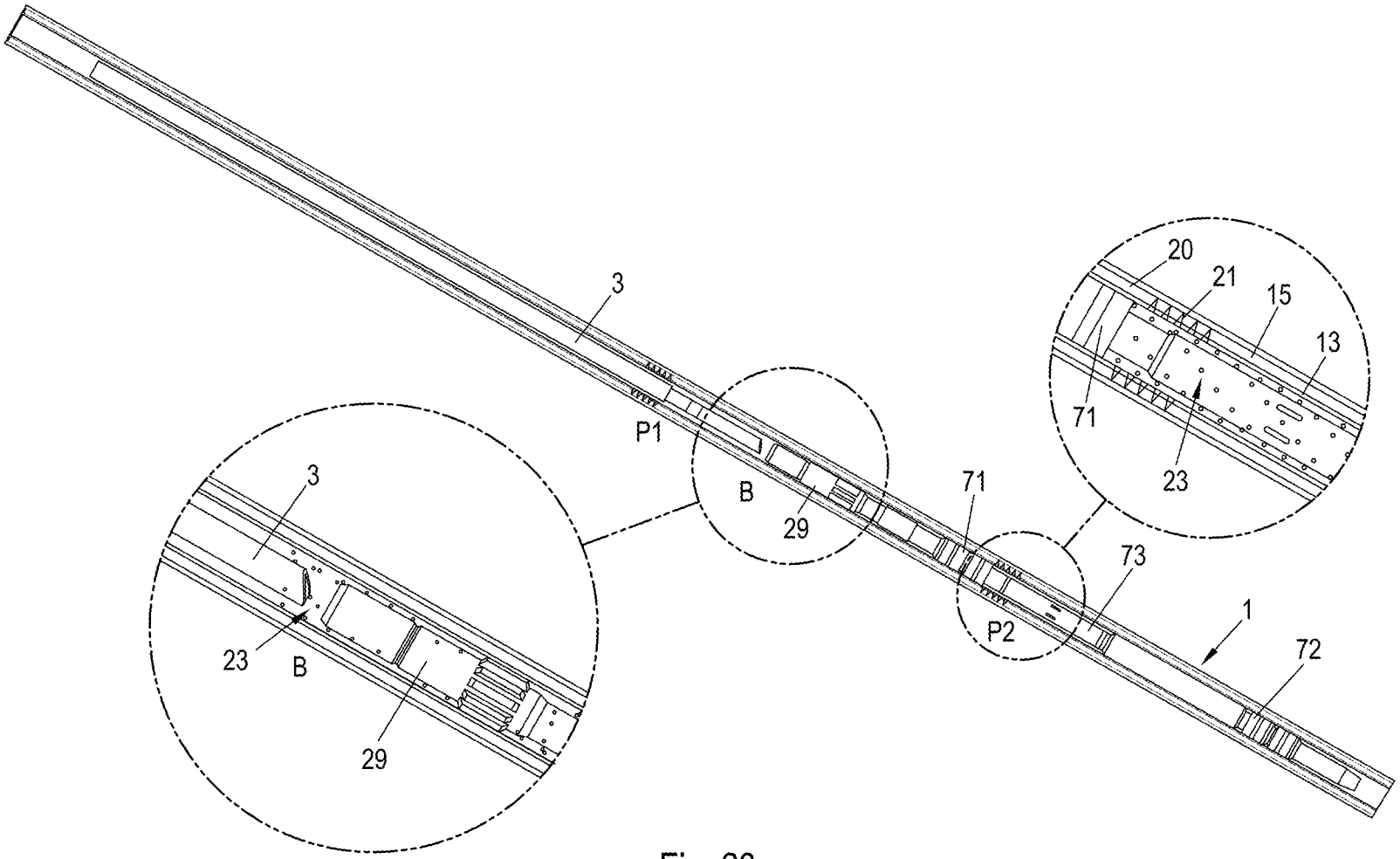
Figure 24:
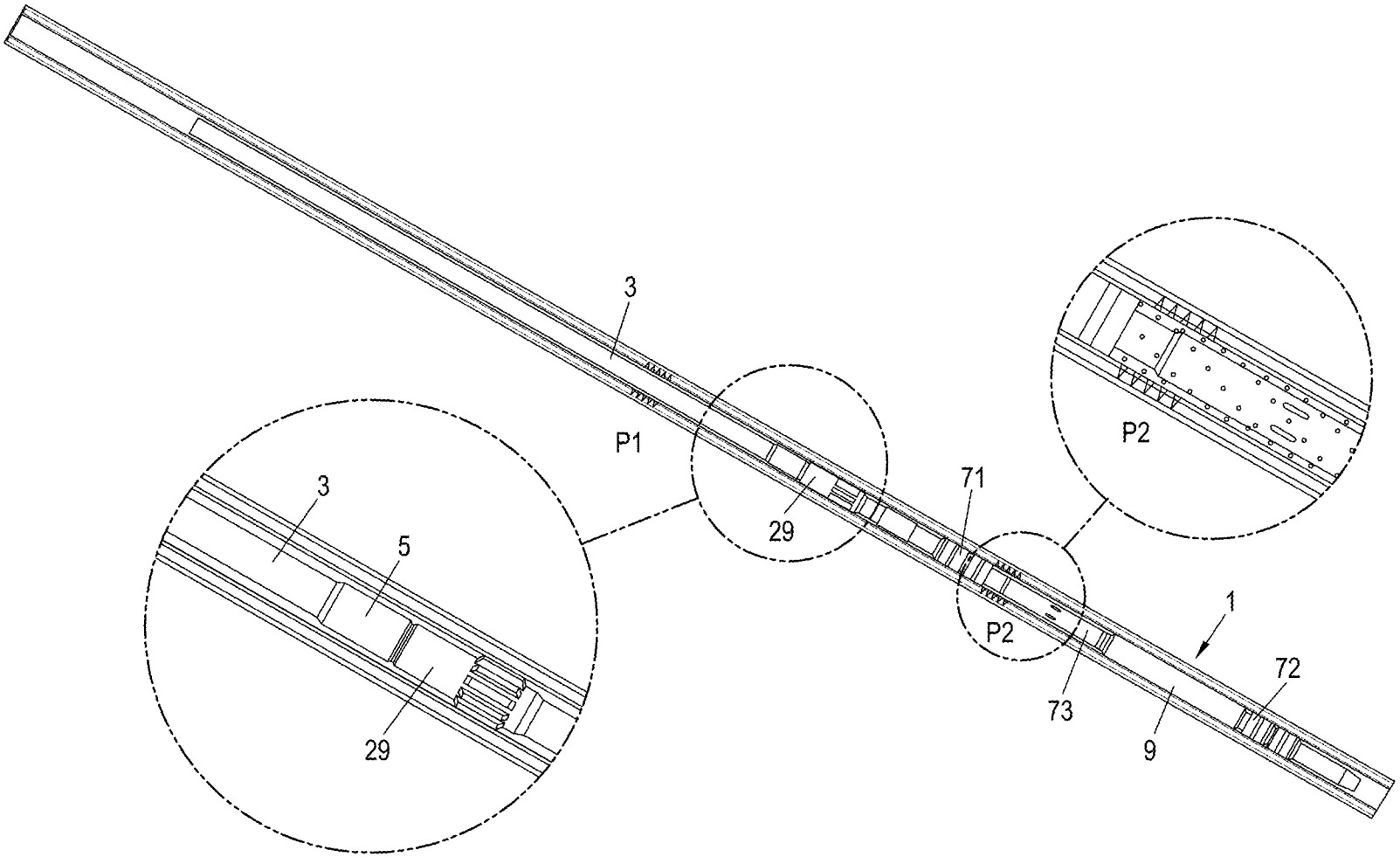
Figure 25:
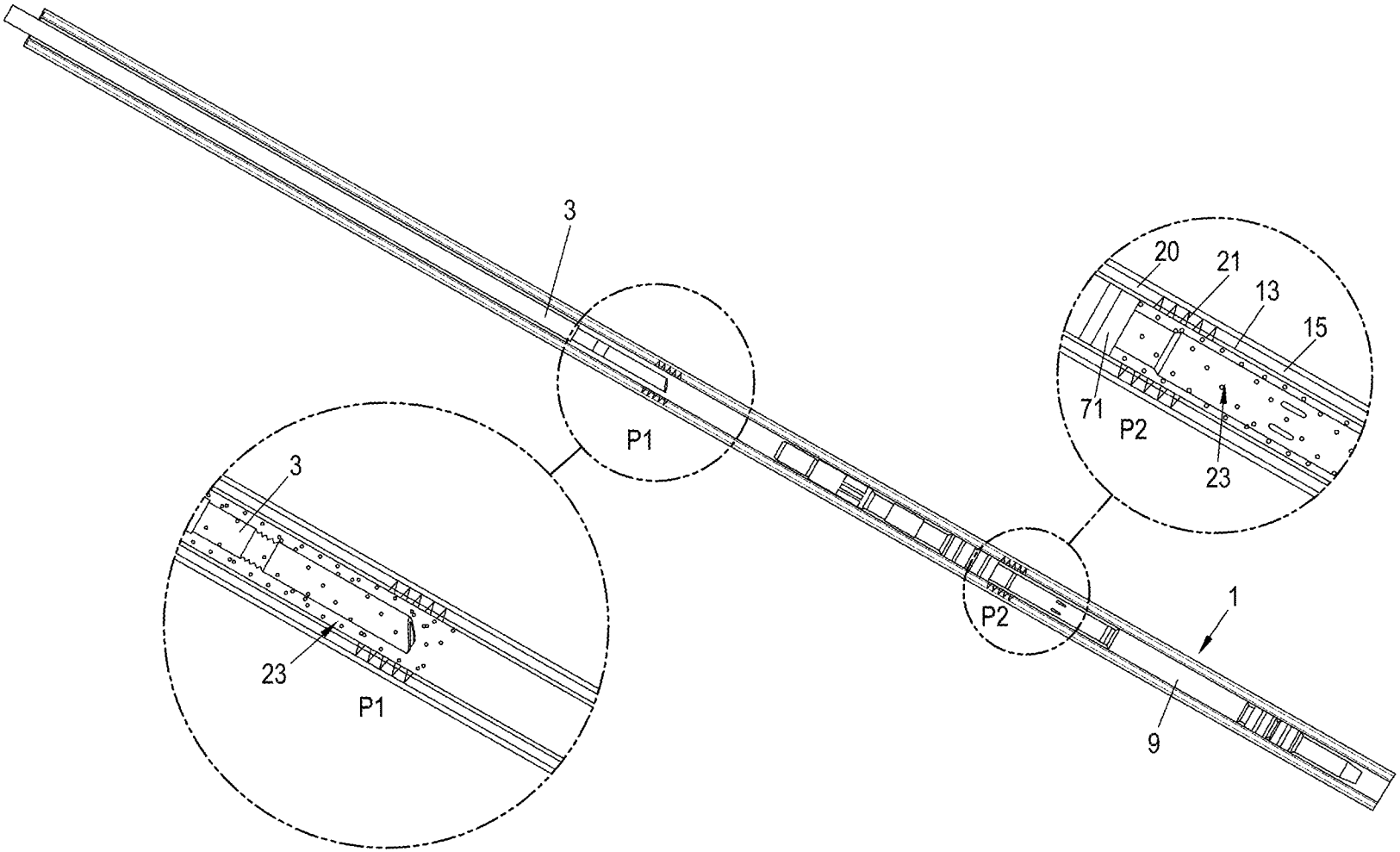
Figure 26:
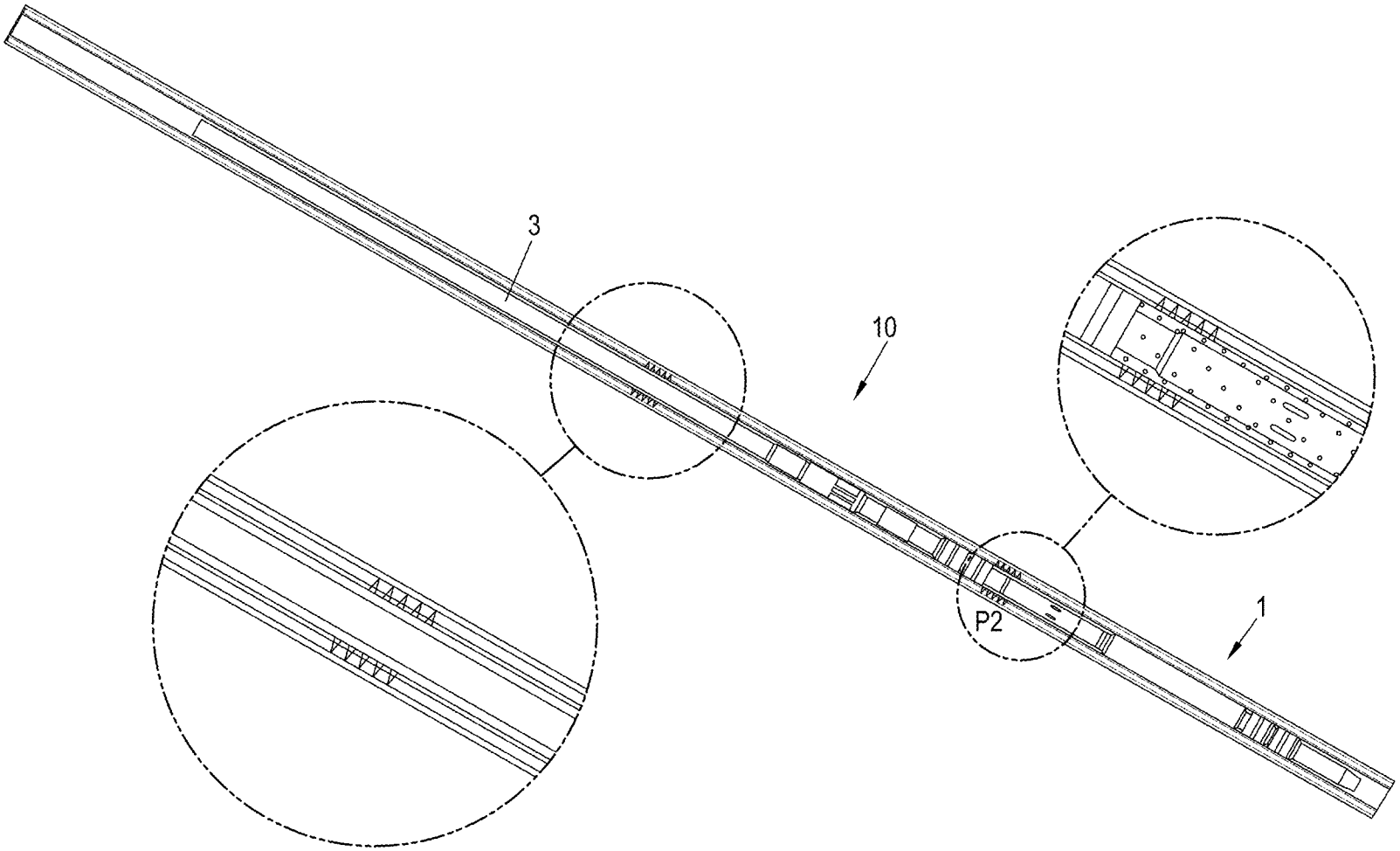

FIG. 22 shows a situation where the upper set of swab cups 71 are not properly set and tracer 23 is leaking through the temporary barrier. FIG. 23 shows that the open end of the drill pipe 3 is moved lower into the well to circulate from a position B closer to the upper set of swab cups 71. Circulation from this position may detect a leak that occurred due to a failing swab cup 71 shown in FIG. 22. As shown in FIG. 24, the drill pipe 3 is stung back into the tool 1, whereby the flapper valve 29 is opened again and the overpressure built up between the sets of swab cups 71, 72 is equalised through the cup-to-cup tool 73 and allowed to migrate up the drill pipe 3. The drill pipe 3 is then once again detached/stung out of the tool 1 so as to circulate to verify that tracer 23 was indeed released from the canister 9 as indicated in FIG. 25. Finally, as shown in FIG. 26, the drill pipe 3 is stung back into the tool 1, and the tool 1 may be retrieved from the well.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. Use of the verb "comprise" and its conjugations does not exclude the presence of elements or steps other than those stated in a claim. The article "a" or "an" preceding an element does not exclude the presence of a plurality of such elements.

The mere fact that certain measures are recited in mutually different dependent claims does not indicate that a combination of these measures cannot be used to advantage.

The invention claimed is:

1. A method for verifying the pressure integrity of a barrier in an annulus located outside of a casing string in a wellbore, the method comprising the steps of:

establishing a first fluid connection through the casing string between an inside of the casing string and the annulus outside the casing string at a first position in the wellbore;

establishing a second fluid connection through the casing string between the inside of the casing string and the annulus outside the casing string at a second position in the wellbore, the second position being offset from the first position along the axial direction of the wellbore, and the barrier in the annulus being located radially outside the casing string and axially between the first and second fluid connections at the first and second positions;

establishing a retrievable barrier in the casing string axially between the first and second fluid connections in the wellbore;

establishing a pressure differential across the retrievable barrier;

releasing a tracer below the retrievable barrier in the wellbore; and sniffing for tracer above the retrievable barrier to verify a leakage through the retrievable barrier and/or the barrier in the annulus, wherein the step of sniffing for tracer above the retrievable barrier comprises:

sniffing for tracer from a position A proximate the fluid connection through the casing string at the first position in the wellbore; and sniffing for tracer from a position B, position B being closer to the retrievable barrier than position A, in the well.

2. The method according to claim 1, wherein the step of sniffing for tracer comprises the steps of circulating well fluid with a fluid-carrying string from a position above the retrievable barrier to topside and sniffing for tracer topside.

3. The method according to claim 2, wherein the method further comprises the steps of:

circulating well fluid with a fluid-carrying string by:

positioning a circulation opening of the fluid-carrying string at position A, proximate the fluid connection through the casing string at the first position in the wellbore;

circulating wellbore fluid from position A in the wellbore to topside;

positioning a circulation opening of the fluid-carrying string at position B, closer to the retrievable barrier in the wellbore; and circulating wellbore fluid from position B in the wellbore to topside.

4. The method according to claim 3, wherein circulation from positions A and B is performed with the same circulation opening in the fluid-carrying string by moving the circulation opening between the first and second positions.

5. The method according to claim 3, wherein circulation from positions A and B is performed without moving the fluid-carrying string, as the fluid-carrying string is provided with two or more circulation openings that are selectively controllable to open/close.

6. The method according to claim 1, wherein the method is performed with a wireline or slickline.

7. The method according to claim 1, wherein sensor data is transferred to topside in real-time.

8. The method according to claim 1, wherein sensor data is stored in memory downhole and collected upon retrieval of the memory topside.

9. The method according to claim 1;

wherein the method further comprises the step of removing the retrievable barrier in the wellbore.

10. The method according to claim 1, wherein position B is five meters above the retrievable barrier.

11. The method according to claim 1, wherein position B is three meters above the retrievable barrier.

12. The method according to claim 1, wherein position B is one meter above the retrievable barrier.

13. The method according to claim 1, comprising establishing the first connection by perforating the casing string.

14. The method according to claim 13, comprising establishing the second connection by perforating the casing string.

15. The method according to claim 1, comprising establishing the first connection by perforating the casing string with a perforating gun.

16. The method according to claim 1, wherein the barrier in the annulus outside the casing string is made of cement.

* * * * *